US008950837B2

(12) United States Patent
Maeda

(10) Patent No.: US 8,950,837 B2
(45) Date of Patent: Feb. 10, 2015

(54) SEALING SHEET, AND LIQUID EJECTION HEAD AND INKJET APPARATUS USING SAME

(75) Inventor: Yasuhiko Maeda, Kanagawa (JP)

(73) Assignee: FUJIFILM Corporation (JP)

( * ) Notice: Subject to any disclaimer, the term of this patent is extended or adjusted under 35 U.S.C. 154(b) by 91 days.

(21) Appl. No.: 13/616,664

(22) Filed: Sep. 14, 2012

(65) Prior Publication Data

US 2013/0070016 A1 Mar. 21, 2013

(30) Foreign Application Priority Data

Sep. 20, 2011 (JP) ..... 2011-205076

(51) Int. Cl.
*B41J 29/38* (2006.01)

(52) U.S. Cl.
USPC ..... 347/5; 347/9; 73/40

(58) Field of Classification Search
USPC ..... 73/40, 706, 40.5, 40.5 R; 324/694; 347/5, 9, 86
See application file for complete search history.

(56) References Cited

U.S. PATENT DOCUMENTS 6,526,807 B1 * 3/2003 Doumit et al. ..... 73/40.5 R
2005/0092070 A1 * 5/2005 Bhatti ..... 73/40

FOREIGN PATENT DOCUMENTS

| | | | |
|---|---|---|---|
| JP | S63-130030 | U | 8/1988 |
| JP | H04-134236 | A | 5/1992 |
| JP | H06-340089 | A | 12/1994 |
| JP | 2004-095224 | A | 3/2004 |
| JP | 2011-079272 | A | 4/2011 |

OTHER PUBLICATIONS

An Office Action, "Notification of Reasons for Rejection," issued by the Japanese Patent Office on Aug. 5, 2013, which corresponds to Japanese Patent Application No. 2011-205076 and is related to U.S. Appl. No. 13/616,664; with partial translation.

* cited by examiner

*Primary Examiner* — Lam S Nguyen
(74) *Attorney, Agent, or Firm* — Studebaker & Brackett PC; Donald R. Studebaker

(57) ABSTRACT

A sealing sheet is configured to restrain at least one of leakage of liquid in and out. The sealing sheet includes: a film member which is impermeable to the liquid and configured to cover a region that needs to be sealed; and electrical wires which are arranged on the film member. An electrical signal corresponding to change in electrical resistance due to contact with the liquid is obtainable from the electrical wires.

15 Claims, 16 Drawing Sheets

SEALING SHEET, AND LIQUID EJECTION HEAD AND INKJET APPARATUS USING SAME

BACKGROUND OF THE INVENTION

1. Field of the Invention

The present invention relates to a sealing sheet configured to prevent leakage of liquid into and out of a device, and to a liquid ejection head and an inkjet apparatus using the sealing seat.

2. Description of the Related Art

Japanese Patent Application Publication No. 2004-095224 discloses liquid leakage sensors for detecting leakage of acidic liquid, such as battery liquid, and an electrical insulating material used in the liquid leakage sensors. One of the liquid leakage sensors has a structure in which band-shaped first and second conductors are arranged in parallel at an interval apart on a sheet-shaped base material, and are covered with a covering layer. The covering layer is made of an electrical insulating material of which the electrical insulating properties decline upon reaction with the battery liquid. The other of the liquid leakage sensors has a structure in which a bonding layer made of the electrical insulating material is arranged between a first conductor layer and a second conductor layer, which are permeable to the acidic liquid, and the insulating properties of the electrical insulating material decline upon reaction with the acidic liquid.

Japanese Patent Application Publication No. 2004-095224 proposes electric circuit compositions for electrically detecting the battery liquid leaking out; however, the proposed liquid leakage sensors are constituted of the members permeable to the liquid, and the covering layers are made of the material that dissolves upon reacting with the battery liquid, which means that the sensors themselves do not serve as sealing members to prevent leakage of the liquid.

For example, in an inkjet head, it is necessary to prevent leakage of internal liquids (e.g., inks or a flow channel cleaning liquid) from the internal flow channels in the inkjet head structure. Moreover, in a case where a cleaning liquid is applied to a nozzle surface (ejection surface) of the inkjet head to clean the nozzle surface soiled by ink ejection, if the external liquids including the cleaning liquid and the previously ejected inks, and the like, leak into the inkjet head and adhere to the piezoelectric elements and the drive circuit wiring, then there is a problem in that the ejection circuit system breaks down.

SUMMARY OF THE INVENTION

Sufficient countermeasures are required in order to prevent the liquid leakage into and out of the inkjet head, and further, sealing mechanisms are required to be capable of rapidly detecting the internal liquid leaking out of the inkjet head and the external liquid going to leak into the inkjet head, and also to be capable of slowing the progress of the liquid leakage, even when the liquid leakage occurs. These problems are not limited to the inkjet heads but common to various apparatuses which handle liquids, and various apparatuses, electronic devices, and the like, which are used in environments using liquids.

The present invention has been contrived in view of these circumstances, an object thereof being to provide a sealing sheet capable of both preventing liquid leakage and detecting any liquid leakage (sealing breakage), and a liquid ejection head and an inkjet apparatus using the sealing sheet.

In order to attain the aforementioned object, the present invention is directed to a sealing sheet configured to restrain at least one of leakage of liquid in and out, the sealing sheet comprising: a film member which is impermeable to the liquid and configured to cover a region that needs to be sealed; and electrical wires which are arranged on the film member, wherein an electrical signal corresponding to change in electrical resistance due to contact with the liquid is obtainable from the electrical wires.

According to this aspect of the present invention, the electrical wires for detecting either one or both of the internal liquid leaking out and the external liquid leaking in are arranged on the liquid-impermeable film member having a covering area sufficient to cover the region that needs to be sealed. In the sealing sheet, the film member itself has the function of preventing the liquid from leaking, and is able to cover and seal an interface region that needs to be sealed. Furthermore, supposing that the sealing effect is broken and the liquid leakage in or out has occurred, it is possible rapidly to detect the abnormality through the electrical wires.

The electrical wires can be used as a device for detecting the internal liquid leaking out or as a device for detecting the external liquid leaking in.

It is also possible to adopt a mode which includes both the electrical wires functioning as the device for detecting the internal liquid leaking out and the electrical wires functioning as the device for detecting the external liquid leaking in.

Preferably, the film member is made of one of resin, metal, and a combination of the resin and the metal.

Preferably, the electrical wires include a pair of a positive electrical wire and a negative electrical wire, the pair constituting a detection circuit.

When the liquid is in contact with the pair of positive and negative electrical wires, a current flows between the wires through the liquid, and the electrical resistance is caused to fall.

Preferably, the film member is configured to be bonded with adhesive to a covered object having the region that needs to be sealed.

According to this aspect of the present invention, it is possible to cause the sealing sheet to adhere tightly to the covered object, and the region that needs to be sealed can be readily covered. Furthermore, even if the liquid leaks in or out through the bonding interface between the sealing sheet and the covered object, it is possible to detect such the abnormality with the electrical signal obtained from the electrical wires.

Preferably, the film member has a bonding layer containing the adhesive configured to bond the sealing sheet to the covered object.

According to this aspect of the present invention, by arranging the bonding layer on the sealing sheet in advance, it is possible to achieve a straightforward and convenient sealing sheet for post-application.

Preferably, the electrical wires are arranged on a side to be bonded to the covered object, of the film member.

According to this aspect of the present invention, it is possible to effectively detect the internal liquid leaking out, and it is also possible to effectively detect the external liquid going to leak into the interface region that needs to be sealed.

Preferably, a space where there is no adhesive is formed around the electrical wires.

According to this aspect of the present invention, if the liquid leakage in or out has occurred, the leakage liquid flows preferentially into the space. Therefore, the leakage detection sensitivity can be improved. Furthermore, the time taken for the leakage liquid to progress further to the inside or the outside can be lengthened.

Preferably, the electrical wires include a plurality of pairs of positive electrical wires and negative electrical wires, the pairs constituting a plurality of detection circuit systems.

According to this aspect of the present invention, for example, there is a mode in which the electrical wires for detecting the internal liquid leaking out and the electrical wires for detecting the external liquid leaking in are arranged. Moreover, it is also possible to adopt a mode in which the wire pairs constituting the plurality of detection circuit systems are arranged for detecting the internal liquid leaking out, and a mode in which the wire pairs constituting the plurality of detection circuit systems are arranged for detecting the external liquid leaking in.

According to this aspect of the present invention, it is possible to separately detect the to internal liquid leaking out and the external liquid leaking in, and to separately identify a location of the leakage.

Preferably, the electrical wires include a pair of a positive electrical wire and a negative electrical wire each of which has comb-shaped electrodes; and the electrodes of the positive electrical wire and the electrodes of the negative electrical wire are alternately arranged on an uppermost surface of the film member.

According to this aspect of the present invention, by alternately arranging the comb-shaped electrodes, it is possible to improve the leakage detection sensitivity.

Preferably, the film member has a multi-terminal connector connected to ends of the electrical wires.

According to this aspect of the present invention, it is possible to extract the wires by gathering the connection terminals of the electrical wires into the connector.

In order to attain the aforementioned object, the present invention is also directed to a liquid ejection head, comprising: a nozzle which has a liquid ejection port configured to eject liquid; a flow channel which is configured to guide the liquid to the nozzle; an ejection energy generating element which is configured to generate ejection energy to eject the liquid from the nozzle; and the above-described sealing sheet which is bonded to the liquid ejection head.

According to this aspect of the present invention, it is possible to achieve the liquid ejection head having high reliability. Furthermore, it is also possible to construct the system which is capable of electrically detecting the abnormality, such as the liquid leakage in and out, or the like, and carrying out suitable control.

Preferably, the liquid ejection head is constituted of a plurality of head modules joined together, and the sealing sheet is bonded to a side face of each of the head modules.

According to this aspect of the present invention, it is possible to obtain a long line head having high reliability. Furthermore, since the abnormality due to the liquid leakage in or out can be rapidly detected in each of the head modules, then it is possible to readily identify a location of the abnormality and appropriately cope with the abnormality by replacing or repairing the leaking head module.

In order to attain the aforementioned object, the present invention is also directed to an inkjet apparatus, comprising: the above-described liquid ejection head; and a warning device which is configured to report an abnormality in accordance with the electrical signal obtained from the electrical wires.

According to this aspect of the present invention, it is possible to achieve the inkjet apparatus having high reliability. Furthermore, it is also possible to rapidly detect the abnormality due to the liquid leakage in or out, and to minimize damage.

According to the present invention, the sealing sheet having both the function of preventing liquid leakage and the function of detecting either one or both of the liquid leaking in and the liquid leaking out is obtained.

Moreover, according to the liquid ejection head which employs the sealing sheet, it is possible to prevent the internal liquid leaking out and the external liquid leaking in, and the liquid ejection head having high reliability can be obtained.

Furthermore, according to the inkjet apparatus using the liquid ejection head, if an abnormality such as the liquid leakage in or out is detected, then it is possible to implement suitable control, such as issuing a warning, informing the user of the head replacement time, and so on.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

First Embodiment

Figure 1:
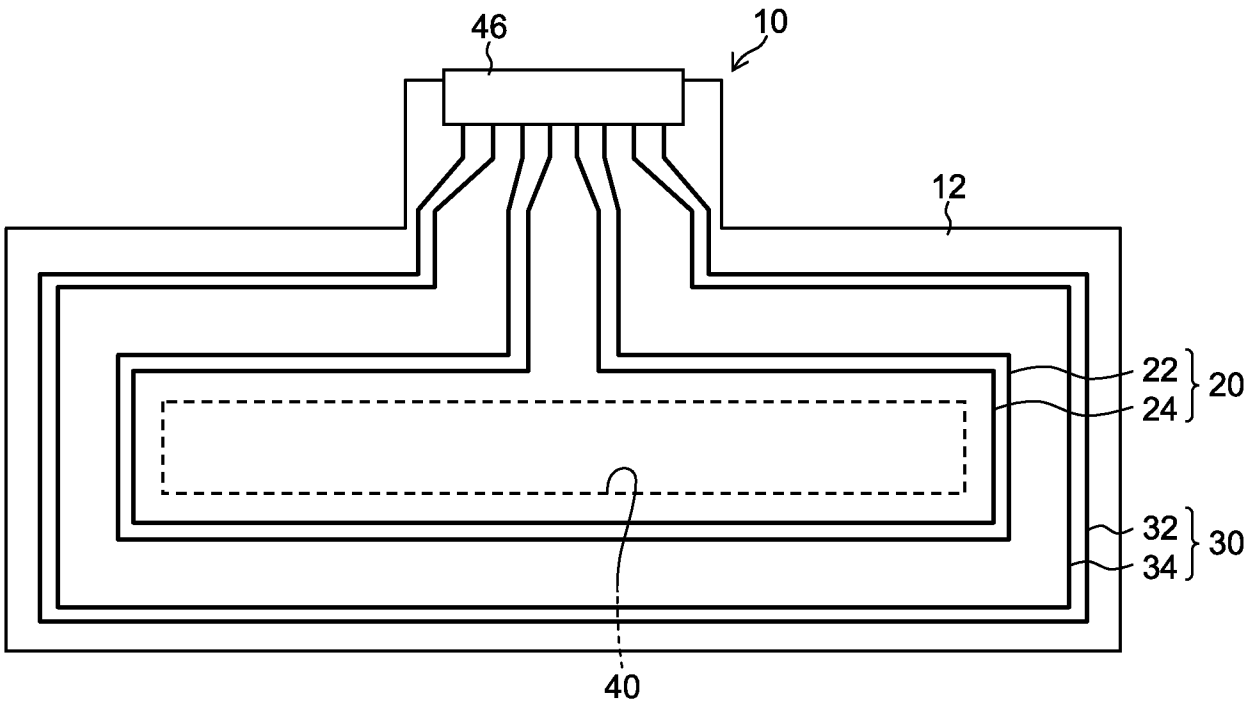
FIG. 1 is a diagram showing a schematic view of a composition of a sealing sheet according to a first embodiment of the present invention.

FIG. 1 is a schematic drawing of the composition of a sealing sheet according to a first embodiment of the present invention. The sealing sheet 10 is a sealing member capable of preventing liquid leakage and configured to be bonded to a portion of an outer surface of an objective device (not shown) at which it is necessary to prevent liquid leakage in and out of the objective device. The sealing sheet 10 can be post-applied onto the outer surface of the objective device.

The sealing sheet 10 has a composition in which electrical wires 22 and 24 functioning as internal leakage detection electrodes 20 configured to detect an internal liquid leaking out of the objective device, and electrical wires 32 and 34 functioning as external leakage detection electrodes 30 configured to detect an external liquid going to leak into the objective device, are arranged on a film member 12 made of a material that is not permeable to the liquids (a liquid-impermeable material).

A rectangular part 40 defined with a dashed line in FIG. 1 is a part (hereinafter referred to as the "sealing part") configured to cover and seal an interface region that needs to be sealed on the objective device. Here, the rectangular sealing part 40 is shown as an example for the sake of the description, but the shape of the sealing part is not limited in particular, and various modes can be adopted. The film member 12 is designed to a suitable size and shape in accordance with the shape and size of the sealing part 40, so as to have the size and shape sufficient to include the sealing part 40 to cover and seal the objective region to be sealed.

For the film member 12, for instance, it is possible to use a film of resin, such as polyimide (PI), polyethylene naphthalate (PEN), polyethylene terephthalate (PET), or the like, or a metal film, such as an expanded metal foil, which is typically made of stainless steel (SUS) or aluminum (Al). It is also possible to use any liquid-impermeable material other than the materials given as examples above. The film thickness of the film member 12 can be suitably set in a range of several micrometers (nm) to several tens micrometers. The film member 12 can be composed of a single-layer structure made of a single material, a multiple-layer structure made of the same material, or a multiple-layer structure made of different materials.

The sealing sheet 10 constituted of the film member 12 is a sheet-shaped (film-shaped) member, which itself functions as a sealing member that prevents permeation of the liquids, and the sealing sheet 10 is bonded to the objective device to cover and seal the sealed region of the objective device with the sealing part 40. Moreover, the sealing sheet 10 has a sensor function (detection circuit composition) of electrically detecting the liquids leaking in and out through a sheet bonding interface between the sealing sheet 10 and the surface of the objective device on which the sealing sheet 10 is bonded.

The internal leakage detection electrodes 20 are constituted of the electrical wire pair, in which the electrical wire 22 functioning as a positive (+) electrode and the electrical wire 24 functioning as a negative (−) electrode are arranged side by side. The two electrical wires 22 and 24 are patterned in loop shapes surrounding the sealing part 40. The electrical resistance of the circuit constituted of the electrical wires 22 and 24 is reduced when the internal liquid comes into contact with the electrical wires 22 and 24, and hence leakage of the internal liquid can be detected on the basis of this change in the electrical resistance.

The wiring patterns of the electrical wires 22 and 24 formed so as to surround the sealing part 40 are substantially perpendicular to the directions of flows of the liquids leaking into and out of the sealing part 40, and the electrical wires 22 and 24 are capable of obstructing the flows of the liquids. Thus, the electrical wires 22 and 24 themselves have functions of restraining the leakage of liquids (i.e., slowing the progress of the leakage).

Similarly, the external leakage detection electrodes 30 are constituted of the electrical wire pair, in which the electrical wire 32 functioning as a positive (+) electrode and the electrical wire 34 functioning as a negative (−) electrode are arranged side by side. The two electrical wires 32 and 34 are patterned in loop shapes surrounding the internal leakage detection electrodes 20 surrounding the sealing part 40. The electrical resistance of the circuit constituted of the electrical wires 32 and 34 is reduced when the external liquid comes into contact with the electrical wires 32 and 34, and hence leakage of the external liquid can be detected on the basis of this change in the electrical resistance.

The wiring patterns of the electrical wires 32 and 34 formed so as to surround the sealing part 40 are substantially perpendicular to the directions of flows of the liquids leaking into and out of the sealing part 40, and the electrical wires 32 and 34 are capable of obstructing the flows of the liquids. Thus, the electrical wires 32 and 34 themselves have functions of restraining the leakage of liquids (i.e., slowing the progress of the leakage).

The connection terminals of the electrical wires 22, 24, 32 and 34 are gathered into a multi-terminal connector 46, and are electrically connected through the connector 46 to a circuit board (not shown). There are no particular restrictions on the specific mode of the electrical connection, and it is possible, for example, to form a wiring path by connecting an intermediate board, or the like, through the connector 46. Even if the number of wires is increased, it is possible to connect the wires to a desired circuit using an intermediate board, or the like, after first gathering the wires in a multi-terminal connector and extracting the wire terminals.

Figure 2A:
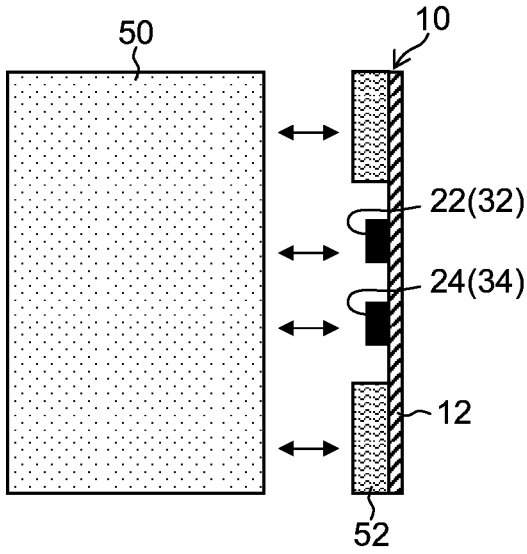
FIGS. 2A and 2B are schematic drawings showing a state of bonding the sealing sheet onto a covered object.
Figure 2B:
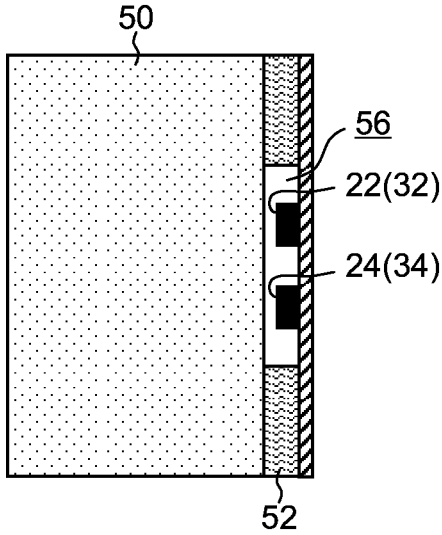

FIGS. 2A and 2B are schematic drawings showing a mode in which the sealing sheet 10 according to the present embodiment is bonded to the covered object (the device to be sealed) 50. The sealing sheet 10 is bonded to the covered object 50 with adhesive 52. The adhesive 52 can be applied beforehand on a surface of the sealing sheet 10, or can be deposited according to requirements. It is desirable that the adhesive 52 is capable of also serving as a sealing agent to prevent the passage of liquid (i.e., a sealing and bonding agent).

When the sealing sheet 10 is bonded to the covered object 50 with the adhesive 52, it is desirable that the adhesive 52 is not applied to the wiring sections where the electrical wires 22 and 24 (or 32 and 34) functioning as the leakage detection electrodes are situated, and that hollow spaces 56 are formed around the wiring sections of the electrical wires 22 and 24 (or 32 and 34) as shown in FIG. 2B.

Figure 3:
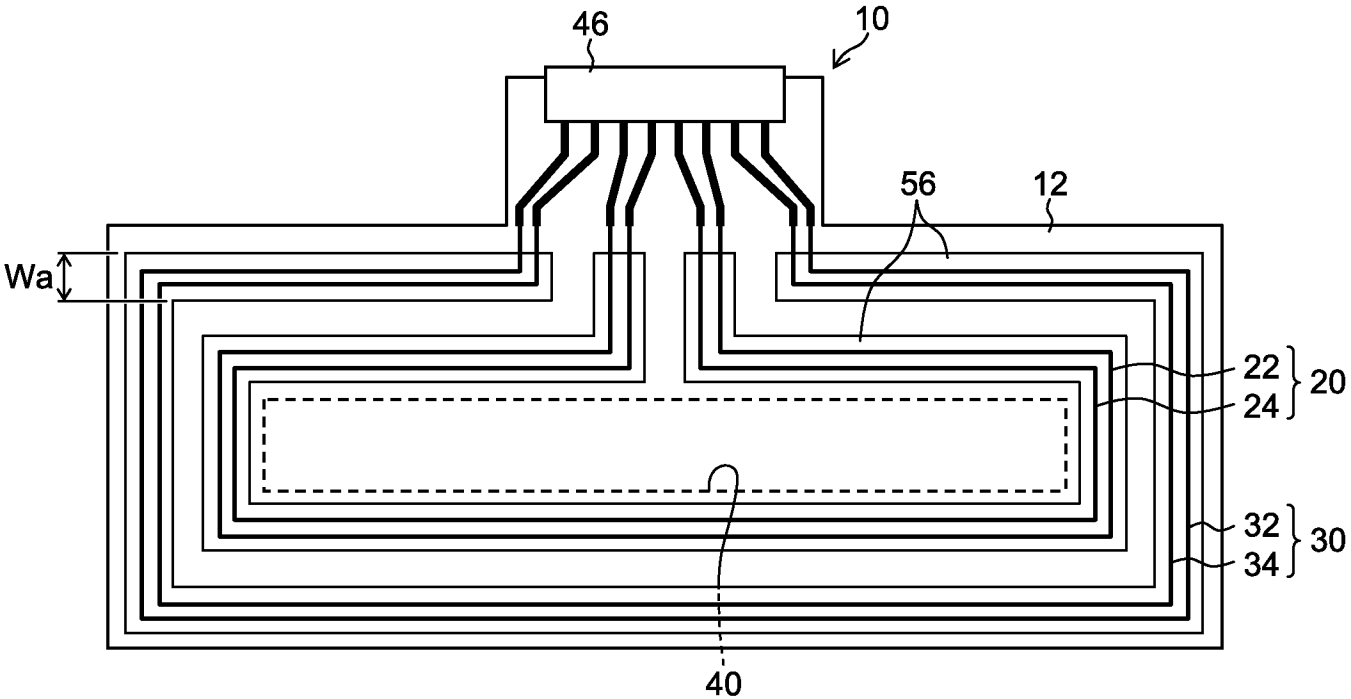
FIG. 3 is a plan view schematic drawing showing spaces without adhesive formed around wiring sections in the sealing sheet.

FIG. 3 is a plan diagram showing the spaces 56 formed around the wiring sections. As shown in FIG. 3, the empty spaces 56 where there is no adhesive 52 are formed around the wiring sections of the leakage detection electrodes 20 and 30. By adopting this composition, the surfaces of the positive and negative electrical wires 22, 24, 32 and 34 are exposed inside the spaces 56 (in a bared state). Therefore, the liquid that has entered the space 56 is liable to make contact with the electrical wires 22 and 24 (or 32 and 34) and cause the electrical resistance between the electrical wires to fall. Consequently, it is possible to raise the sensitivity of the electrical detection of any leakage.

Moreover, according to the composition in FIG. 3, since the leakage detection electrodes 20 and 30 are substantially arranged perpendicularly to the direction in which the leakage liquid moves (the direction of flow of the liquid leaking out or in) along the sheet bonding interface between the sealing sheet 10 and the surface of the objective device on which the sealing sheet 10 is bonded, then the leakage liquid preferentially enters the spaces 56 formed around the wiring sections, and the time taken for the leakage liquid to progress further to the outside (or the inside) can be lengthened. In other words, if the internal liquid has leaked out of the sealing part 40 or the external liquid has leaked in from outside the sealing sheet 10 through the sheet bonding interface, then because the flow channel resistance of the spaces 56 formed around the wiring sections is low, the leakage liquid flows preferentially into the spaces 56. Consequently, the leakage liquid is held inside the spaces 56, up to the volume which can be accommodated in the spaces 56, and subsequent further leaking of the liquid is slowed.

It is possible to arrange an environmental air connection hole in each space 56 at a portion where there is a low risk of liquid leakage. The "portion where there is a low risk of liquid leakage" is specified in accordance with the mode of use of the sealing sheet 10. For example, in a mode of use of the sealing sheet 10 where the sealing sheet 10 is bonded to a vertical surface of the covered object 50 while the sealing sheet 10 is held in the upright posture shown in FIG. 3 in such a manner that the lower side of the sealing sheet 10 in FIG. 3 is principally exposed to the external liquid, then the upper portion of the space 56 which is situated in a position higher than the upper edge of the sealing part 40 in FIG. 3 corresponds to the "portion where there is a low risk of liquid leakage".

Instead of the mode where the environmental air connection holes are formed in the spaces 56, or in conjunction with such the mode, it is also possible to fill the spaces 56 with gas such as nitrogen, or another resin material or porous material.

The intervals between the wires of the positive (+) and negative (−) electrodes constituting the leakage detection electrodes 20 and 30 can be designed appropriately, and in order to raise the leakage detection sensitivity, and also from the viewpoint of minimizing the region where there is no adhesive 52, it is desirable that the line (L) and space (S) is in a range of L/S not smaller than 10/10 (μm) and not larger than 50/50 (μm), for example.

Furthermore, the width (in the direction perpendicular to the wires) Wa of the area (space 56) where there is no adhesive 52 in the vicinity of the wires can be designed to a suitable width in accordance with the wiring interval (L/S). For example, it is desirable that Wa is designed appropriately in a range of not smaller that 50 μm and not larger than 150 μm.

<<Embodiments of Manufacturing Process>>

Figure 4A:
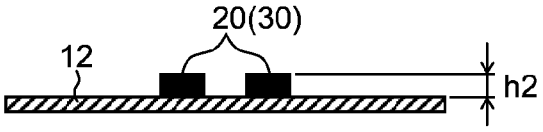
FIGS. 4A and 4B are illustrative diagrams of a manufacturing process for directly patterning an adhesive onto a film member.
Figure 4B:
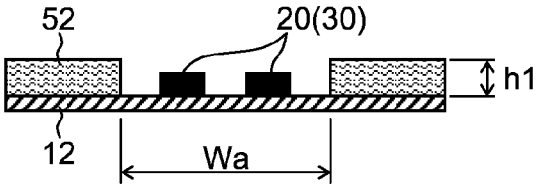

FIGS. 4A and 4B and FIGS. 5A to 5C show embodiments of methods in which the adhesive 52 (preferably also serving as the sealing agent) is applied while leaving the space 56 in the wiring section. FIGS. 4A and 4B show a process for forming a pattern of the adhesive 52 directly on the film member 12 (direct patterning), by screen printing, inkjet printing, or the like.

As shown in FIG. 4A, the film member 12 on which a wiring pattern of the leakage detection electrodes 20 (and 30) has been arranged is prepared, and as shown in FIG. 4B, the adhesive 52 is patterned by screen printing or inkjet printing onto the same surface of the film member 12 as the surface on which the leakage detection electrodes 20 (and 30) have been arranged. The portion formed by the adhesive 52 shown in FIG. 4B functions as a "bonding layer".

Figure 5A:
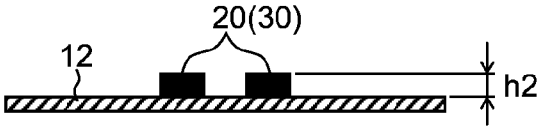
FIGS. 5A to 5C are illustrative diagrams of a manufacturing process for forming wall sections by photolithography on a film member and then subsequently transferring the adhesive.
Figure 5B:
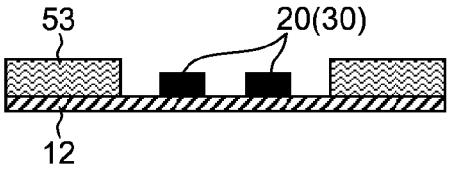
Figure 5C:
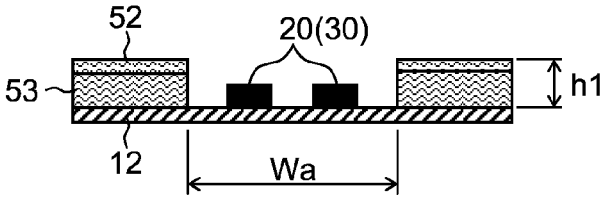

FIGS. 5A to 5C show a process which combines forming a wall section by photolithography and transferring the adhesive.

As shown in FIG. 5A, the film member 12 on which a wiring pattern of the leakage detection electrodes 20 (and 30) has been arranged is prepared, and as shown in FIG. 5B, walls 53 are patterned using a photosensitive material onto the same surface of the film member 12 as the surface on which the leakage detection electrodes 20 (and 30) have been arranged. For example, the photosensitive material can be SU-8 (product name) of Nippon Kayaku. By applying the photosensitive resin to the film member 12 and then carrying out exposure and development processes by means of the photolithography technique, it is possible to form the desired pattern.

Thereupon, as shown in FIG. 5C, the adhesive 52 is transferred to the upper or top faces of the walls 53, which have been patterned. For example, the adhesive 52 is applied to a roller surface and then transferred from the roller surface to the walls 53. Thereby, the wall sections (adhesive sealing layers) having a laminated structure in which the adhesive 52 is layered on the walls 53 made of the photosensitive material are formed. The wall section constituted of the laminated structure of the wall 53 and the adhesive 52 as shown in FIG. 5C functions as the "bonding layer".

The relationship between the height h1 of the wall sections for forming the space 56 (the film thickness of the adhesive 52 in FIG. 4B or the thickness of the laminated body constituted of the wall 53 of the photosensitive material and the adhesive 52 in FIG. 5C), and the height (thickness) h2 of the wires of the leakage detection electrodes 20 or 30, is desirably such that, if the surface of the covered object 50 is an insulator, then it is possible to adopt a composition in which the height h2 of the wiring portion is lower than the height h1 of the wall (i.e., h1>h2) or the both heights are the same (i.e., h1=h2), whereas if the surface of the covered object 50 is a conductor, then it is desirable that the height h2 of the wiring portion is lower than the height h1 of the wall (i.e., h1>h2).

Furthermore, it is also possible to adopt a composition in which the adhesive sealing layer is formed on the film member 12, by the method such as that described in FIGS. 4A and 4B, or FIGS. 5A to 5C, and the surface where the adhesive sealing layer has been formed is covered with a release liner (not shown), or the like. According to this mode, the release liner is peeled to expose the adhesive sealing layer in accordance with requirements, and then the sealing sheet can be bonded to the covered object. The sealing sheet in this mode is a simple device as a sealing member which can be used for post-application.

<Composition when Using Metal Film>

Figure 6:
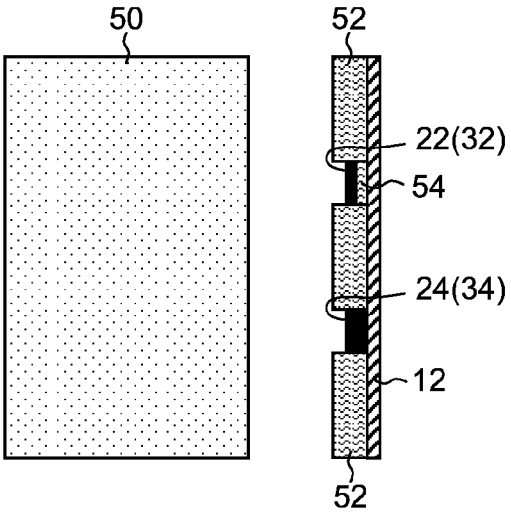
FIG. 6 is an illustrative diagram showing an arrangement of electrodes in a case of using a metal film.

It is desirable that the film member 12 can also prevent water vapor from entering the device or the covered object 50, and the film member 12 can be made of metal foil (metal film)

such as aluminum foil or stainless steel foil. If the metal foil is used for the film member 12, then it is desirable that at least one of the positive (+) and negative (−) electrodes is arranged so as to be electrically insulated from the metal foil as shown in FIG. 6. FIG. 6 shows an example of a composition in which the positive (+) electrical wire 22 (or 32) is electrically insulated by an insulating layer 54 from the film member 12 made of metal foil. Instead of the composition in FIG. 6, it is also possible to adopt a composition in which an insulating layer is interposed between the negative (−) electrical wire 24 (or 34) and the film member 12.

The film member 12 is not limited to a single layered metal film or a single layered resin film, and it is also possible to compose the film member 12 by suitably combining a metal film and a resin film (for example, a laminated structure constituted of a plurality of layers).

<Action and Beneficial Effects of the First Embodiment>

The sealing sheet 10 according to the first embodiment is configured to function as the sealing film that is bonded to the covered object 50 to cover and seal the region that needs to be sealed in the covered object 50 with the sealing part 40. Moreover, if for some reason the sealing part 40 has failed to prevent the internal liquid from leaking out of the covered object 50 despite having the film member 12, then the positive and negative electrical wires 22 and 24 of the internal leakage detection electrodes 20 are shorted by the leakage liquid that has passed through the sheet bonding interface between the sealing part 40 and the surface of the covered object 50. Thereby, it is possible to detect the internal liquid leaking out, by measuring the electrical resistance between the electrical wires 22 and 24.

When the liquid spans between the electrical wires 22 and 24, the electrical resistance between the electrical wires 22 and 24 becomes smaller. If no liquid is present between the electrical wires 22 and 24, then the electrical resistance between the electrical wires 22 and 24 exhibits a higher value (substantially an open state). Consequently, it is possible to identify the presence or absence of the liquid from the differential in the electrical resistance between the electrical wires 22 and 24, and an abnormality (leakage of the internal liquid) can be detected if the resistance value falls. More specifically, the electrical resistance value is measured from the electrical signal obtained through the electrical wires 22 and 24, and if this measurement result is outside a normal range (a predetermined allowable range), then the abnormality is identified and an error signal can be issued.

If for some reason the sealing sheet 10 has failed to prevent the external liquid from leaking in through the sheet bonding interface between the sealing sheet 10 and the surface of the covered object 50, then the electrical wires 32 and 34 of the positive and negative electrodes of the external leakage detection electrodes 30 are shorted by the leakage liquid. Thereby, it is possible to detect the external liquid leaking in, by measuring the electrical resistance between the electrical wires 32 and 34.

When the liquid spans between the electrical wires 32 and 34, the electrical resistance between the electrical wires 32 and 34 becomes smaller. If no liquid is present between the electrical wires 32 and 34, then the electrical resistance between the electrical wires 32 and 34 exhibits a higher value (substantially an open state). Consequently, it is possible to identify the presence or absence of the liquid from the differential in the electrical resistance between the electrical wires 32 and 34, and an abnormality (leakage of the external liquid) can be detected if the resistance value falls. More specifically, the electrical resistance value is measured from the electrical signal obtained through the electrical wires 32 and 34, and if this measurement result is outside a normal range (a predetermined allowable range), then the abnormality is identified and an error signal can be issued.

According to the present embodiment, it is possible to rapidly detect the abnormalities due to the liquid leakage in and out.

Modification Embodiment 1

In the embodiment described with reference to FIGS. 1 to 6, in order to individually identify leakage of the internal liquid and leakage of the external liquid, the detection electrodes (detection circuits) of two systems are prepared, namely, the system including the positive and negative electrical wires 22 and 24 configured to detect the internal liquid leaking out, and the system including the positive and negative electrical wires 32 and 34 configured to detect the external liquid leaking in; however, the mode of wiring the electrode pairs for detecting the leakage can be designed freely in accordance with the portion of the device that is to be sealed or the shape of the interface that needs to be sealed, and the like.

Furthermore, it is also possible to adopt a mode in which either the internal leakage detection electrodes configured to detect the internal liquid leaking out or the external leakage detection electrodes configured to detect the external liquid leaking in, are omitted. For example, if it is sufficient to be able to detect leakage of the internal liquid only, then the external leakage detection electrodes 30 can be omitted. On the other hand, if it is sufficient to be able to detect leakage of the external liquid only, then the internal leakage detection electrodes 20 can be omitted.

Alternatively, in at least one of the internal leakage detection electrodes 20 and the external leakage detection electrodes 30, it is possible to arrange positive and negative electrical wires of a plurality of systems in order to identify a leakage location.

Second Embodiment

Figure 7:
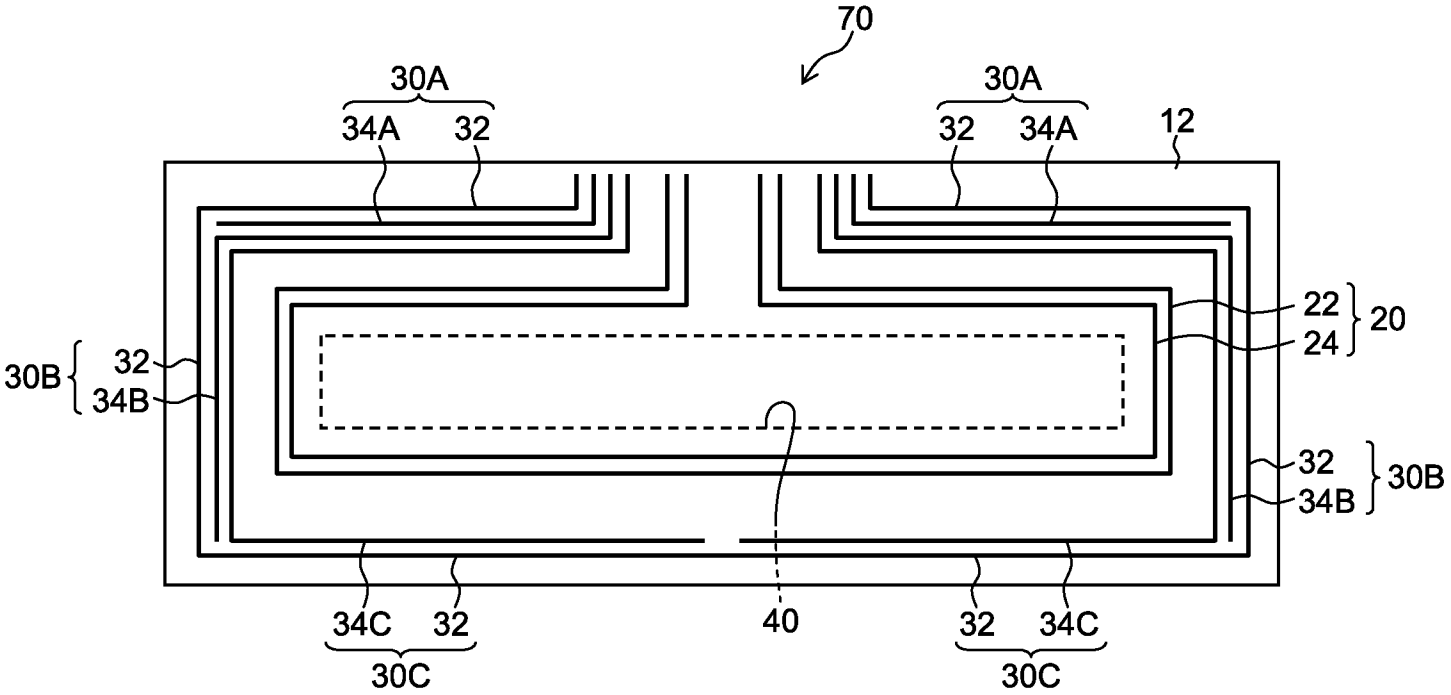
FIG. 7 is a diagram showing a schematic view of a composition of a sealing sheet according to a second embodiment of the present invention.

FIG. 7 is a schematic drawing of the composition of a sealing sheet 70 according to a second embodiment of the present invention. In FIG. 7, elements which are the same as or similar to those in the first embodiment described with reference to FIGS. 1 to 6 are denoted with the same reference numerals, and description thereof is omitted here.

In the sealing sheet 70 shown in FIG. 7, in order to identify a location of the leakage of the external liquid, electrode pairs of a plurality of systems are arranged as circuits configured to detect the external liquid leaking in. In FIG. 7, leakage detection electrodes 30A constituted of a pair of electrodes 32 and 34A configured to detect the leakage of the external liquid at the upper part of the sealing sheet 70 in FIG. 7, leakage detection electrodes 30B constituted of a pair of electrodes 32 and 34B configured to detect the leakage of the external liquid at the lateral part of the sealing sheet 70 in FIG. 7, and detection electrodes 30C constituted of a pair of electrodes 32 and 34C configured to detect the leakage of the external liquid at the lower part of the sealing sheet 70 in FIG. 7, are arranged in lateral symmetry with respect to the sealing part 40.

Thus, the sealing sheet 70 shown in FIG. 7 has the electrical wires of six systems as the external leakage detection circuits, whereby it is possible to separately detect the leakages of the external liquid from the upper right direction, the right side direction, the lower right direction, the lower left direction, the left side direction, and the upper left direction.

Although the connector 46 is not shown in FIG. 7, the end portions of the electrical wires 22, 24, 32, 34A, 34B and 34C are gathered into a multi-terminal connector (here, a connector with no less than twelve pins) (not shown), and are externally extracted similarly to the embodiment shown in FIG. 1.

In FIG. 7, the electrical wire 32 functions as the positive (+) electrode common to all of the systems of the external leakage detection circuits, and the electrical wires 34A, 34B and 34C are separately arranged to function as the negative (−) electrodes in the respective systems, but conversely to this, it is also possible to adopt a mode in which the common electrical wire functions as the negative (−) electrode, and the electrical wires functioning as the positive (+) electrodes are separately arranged for the respective systems.

Figure 8:
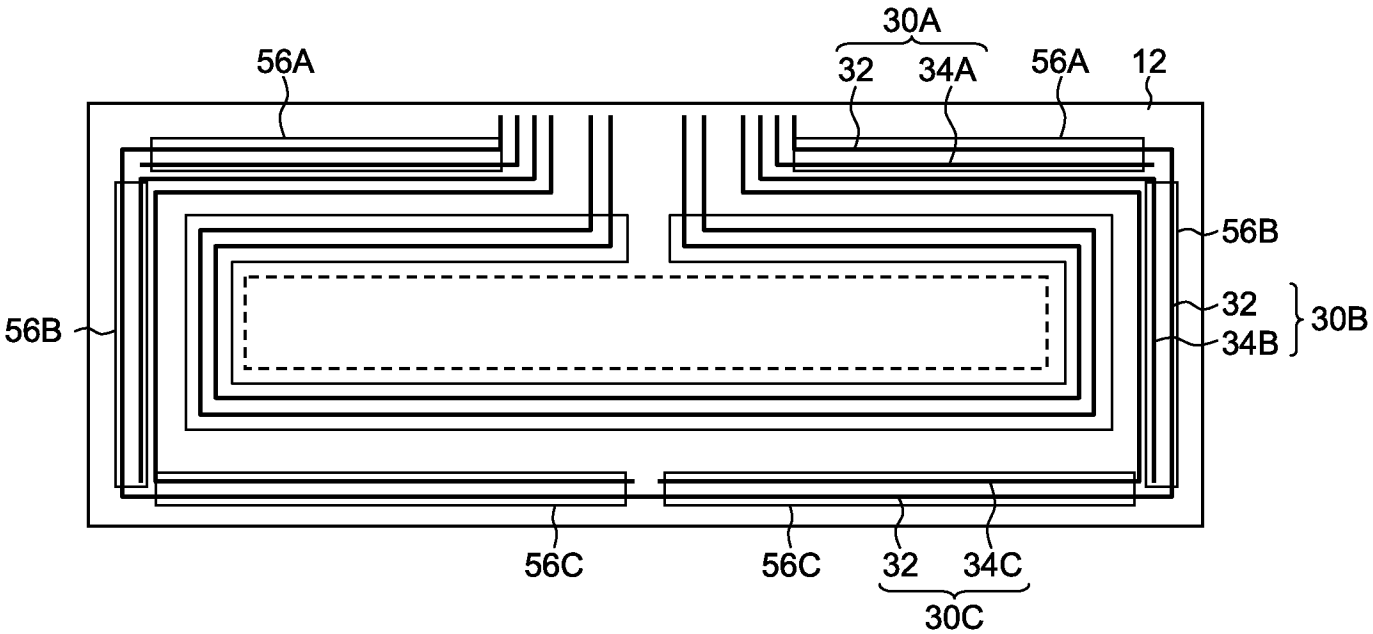
FIG. 8 is a plan view schematic drawing showing spaces without the adhesive formed around wiring sections in the sealing sheet in the second embodiment.

FIG. 8 is a plan diagram showing a case where the spaces without the adhesive are formed in the sealing sheet 70 according to the second embodiment shown in FIG. 7. In FIG. 8, elements which are the same as or similar to those described with reference to FIGS. 3 and 7 are denoted with the same reference numerals, and description thereof is omitted here.

As shown in FIG. 8, the spaces 56A, 56B and 56C are formed respectively around the leakage detection electrodes 30A, 30B and 30C of the systems of the external leakage detection circuits. Thus, by forming the spaces 56A, 56B and 56C without the adhesive 52 respectively around the leakage detection electrodes in the respective wire pairs of the systems, then it is possible to improve the leakage detection sensitivity, and slowing the progress of any liquid leakage in and out.

Although the plurality of systems are arranged for the external leakage detection circuits in FIGS. 7 and 8, it is also possible to adopt a composition in which a plurality of systems are arranged for the internal leakage detection circuits configured to detect the internal liquid leaking out, so that the location of any leakage of the internal liquid can be identified.

Third Embodiment

Figure 9:
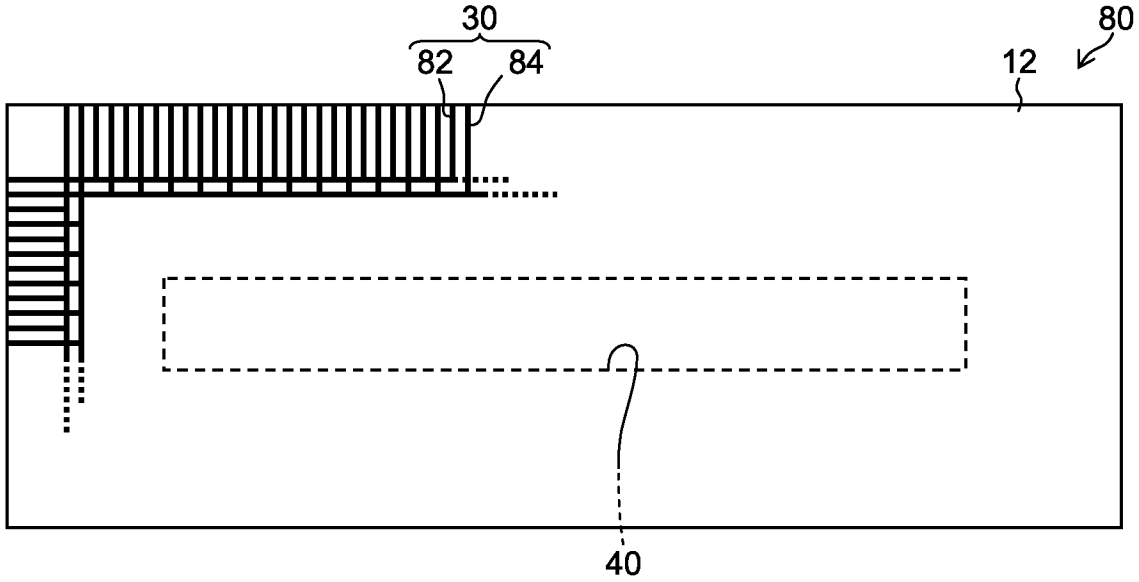
FIG. 9 is a diagram showing a schematic view of a composition of a sealing sheet according to a third embodiment of the present invention.

FIG. 9 is a schematic drawing of the composition of a sealing sheet 80 according to a third embodiment of the present invention. In FIG. 9, elements which are the same as or similar to those described with reference to FIGS. 1 to 6 are denoted with the same reference numerals and further explanation thereof is omitted here. FIG. 9 does not depict the connector 46, but similarly to FIG. 1, the end portions of the electrical wires are gathered into a multiple-terminal connector (not shown) and extracted.

In the sealing sheet 80 shown in FIG. 9, each of a positive electrical wire 82 and a negative electrical wire 84 constituting the external leakage detection electrodes 30 is formed in a comb shape, and the two electrodes are arranged alternately on the surface of the film member 12.

FIG. 9 is a conceptual diagram of the wiring pattern of the leakage detection electrodes, and depicts the positive comb-shaped electrode 82 and the negative comb-shaped electrode 84 as crossing each other, but in actual practice, the wiring patterns of the respective electrodes are arranged in three-dimensionally different layers in the direction perpendicular to the film surface (the thickness direction), and therefore an insulating layer is interposed between the electrodes 82 and 84, and the electrodes 82 and 84 do not make contact with each other.

Figure 10:
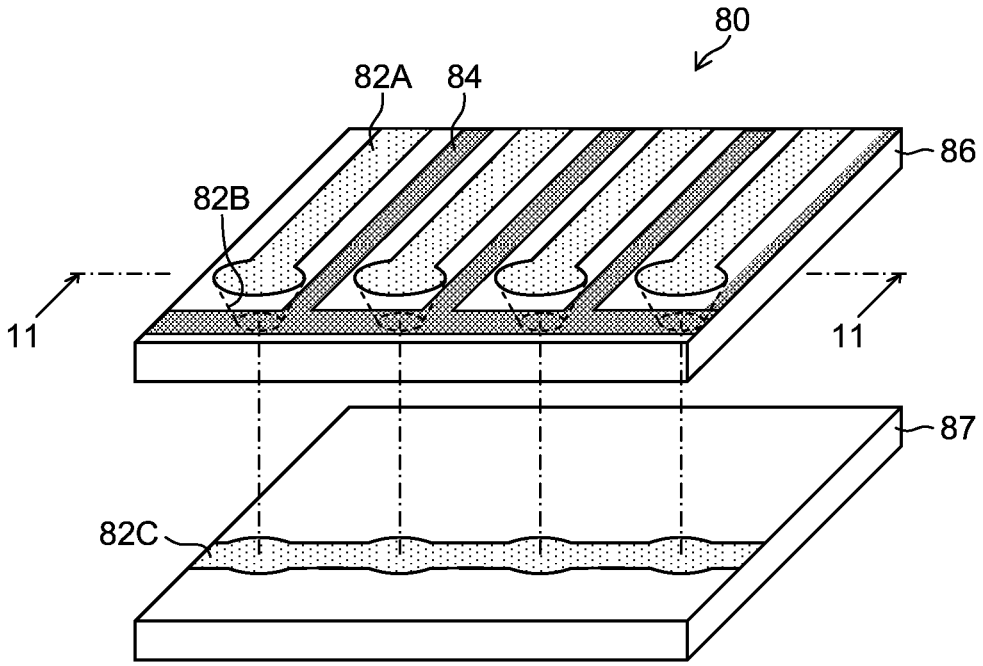
FIG. 10 is an exploded perspective diagram showing a structure of comb-shaped detection electrodes of the sealing sheet in the third embodiment.
Figure 11:
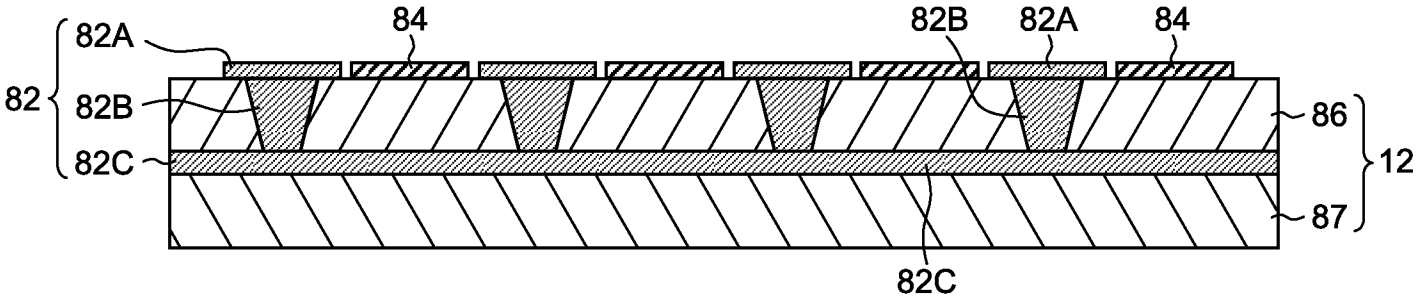
FIG. 11 is a cross-sectional diagram along line 11-11 in FIG. 10.
Figure 12A:
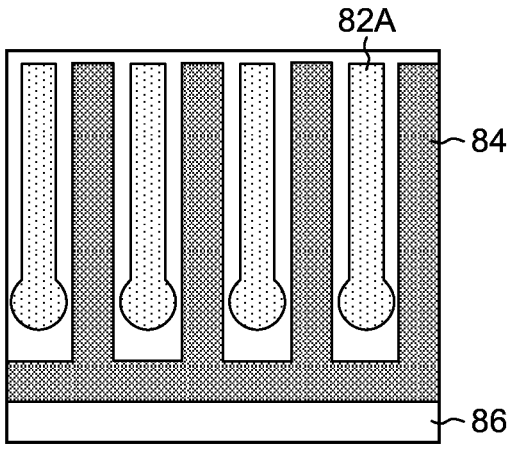
FIG. 12A is a plan diagram of an uppermost surface of the sealing sheet shown in FIG. 10.
Figure 12B:
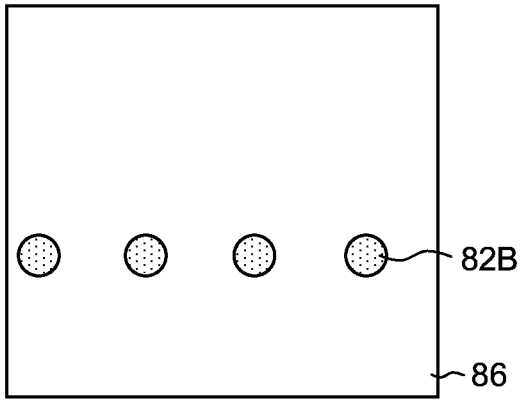
FIG. 12B is a horizontal cross-sectional diagram of a plane where vias connecting from the uppermost surface to a second layer are formed.
Figure 12C:
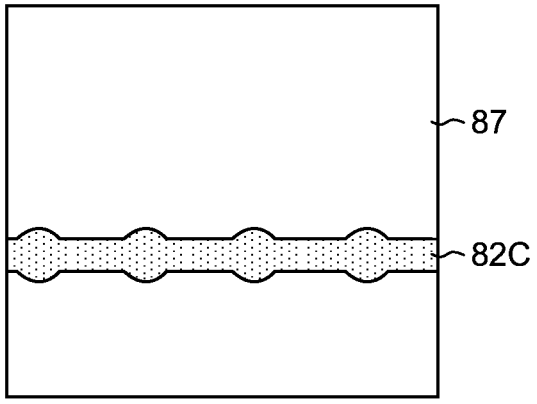
FIG. 12C is a diagram showing a wiring pattern formed in the second layer.

FIG. 10 is a schematic exploded perspective diagram of the comb-shaped detection electrodes shown in FIG. 9. FIG. 11 is a cross-sectional diagram along line 11-11 in FIG. 10. FIG. 12A is a plan diagram of the uppermost surface (first layer) in FIG. 10, FIG. 12B is a plan diagram of vias 82B, which connect the electrodes of the uppermost surface with the electrodes of a lower layer (second layer), and FIG. 12C is a plan diagram of a wiring pattern formed in the second layer in FIG. 10.

As shown in FIGS. 10 to 12A, the film member 12 of the sealing sheet 80 has a two-layer structure, in which a first film 86 and a second film 87 are bonded together, and the positive and negative electrical wires 82 and 84 are exposed on the uppermost surface of the first film 86. The negative electrical wire 84 is formed in a comb-shaped pattern on the uppermost surface of the first film 86. A plurality of line-shaped electrodes 82A functioning as the positive electrical wire 82 are formed on the uppermost surface of the first film 86.

The vias 82B, which connect to the respective line-shaped electrodes 82A, are formed in the first film 86. A positive wiring pattern 82C is formed on the second film 87 of the second layer, and the line-shaped electrodes 82A are connected through the vias 82B commonly to the positive wiring pattern 82C. The line-shaped electrodes 82A formed on the uppermost surface of the first film 86 are connected to the wiring pattern 82C in the second layer by means of the vias 82B, which pass through the first film 86. A composition is achieved in which the wires connected to the electrodes 82A are extracted to a connection terminal (not shown) by means of the wiring pattern 82C of the second layer. Thereby, the positive electrical wire 82 is constituted of the line-shaped electrodes 82A, the vias 82B and the wiring pattern 82C.

In the sealing sheet 80 according to the third embodiment shown in FIGS. 9 to 12C, the positive and negative electrodes formed in the comb shapes are alternately arranged on the uppermost surface. By forming very fine wire patterns in this way, the leakage detection sensitivity can be further improved. Moreover, with the wiring mode in which the wires are arranged in parallel in this way, the wires are arranged along the directions substantially coinciding with the directions in which the external liquid leaks in along the film surface (the contact interface with the surface of the objective device), and therefore the leakage liquid can move readily along the wires (i.e., the leakage liquid can be readily attracted around the wires). Consequently, if the external liquid leaks in, this mode of the sealing sheet 80 readily guides the leakage liquid to the wiring portions and thus enables rapid detection of the abnormality regarding the external liquid leaking in.

Although the internal leakage detection electrodes 20 are not shown in FIG. 9, the internal leakage detection electrodes 20 can be arranged similarly to the sealing sheet 10 in the first embodiment.

Modification Embodiment 2

In cases where the internal leakage detection electrodes and the external leakage detection electrodes are arranged on the film member, the arrangement is not necessarily limited to a mode where these detection electrodes are arranged on the same surface of the film member. For example, it is also possible to adopt a mode in which the internal leakage detection electrodes are formed on one surface (a bonding surface) of the film member 12, and the external leakage detection electrodes are formed on the opposite surface of the film member 12. In a mode of use of the sealing sheet where there is little possibility of the outer surface of the sealing sheet being exposed directly to liquid, for instance, in a case where a cover member, or the like, is separately arranged to further cover the outside of the sealing sheet, then it is possible to adopt a composition in which the leakage detection electrodes are arranged on the opposite surface to the bonding surface of the film member.

Modification Embodiment 3

Although each of the sealing sheets in the above-described embodiments has the bonding layer constituted of the adhesive 52 on the surface of the film member 12, it is also possible to adopt a mode of a sealing sheet that does not have the layer of the adhesive 52. When using the sealing sheet on which no bonding layer constituted of the adhesive 52 has been previously formed, the adhesive is applied onto the bonding surface according to requirements.

<Embodiment of Composition of Inkjet Head>

Figure 13:
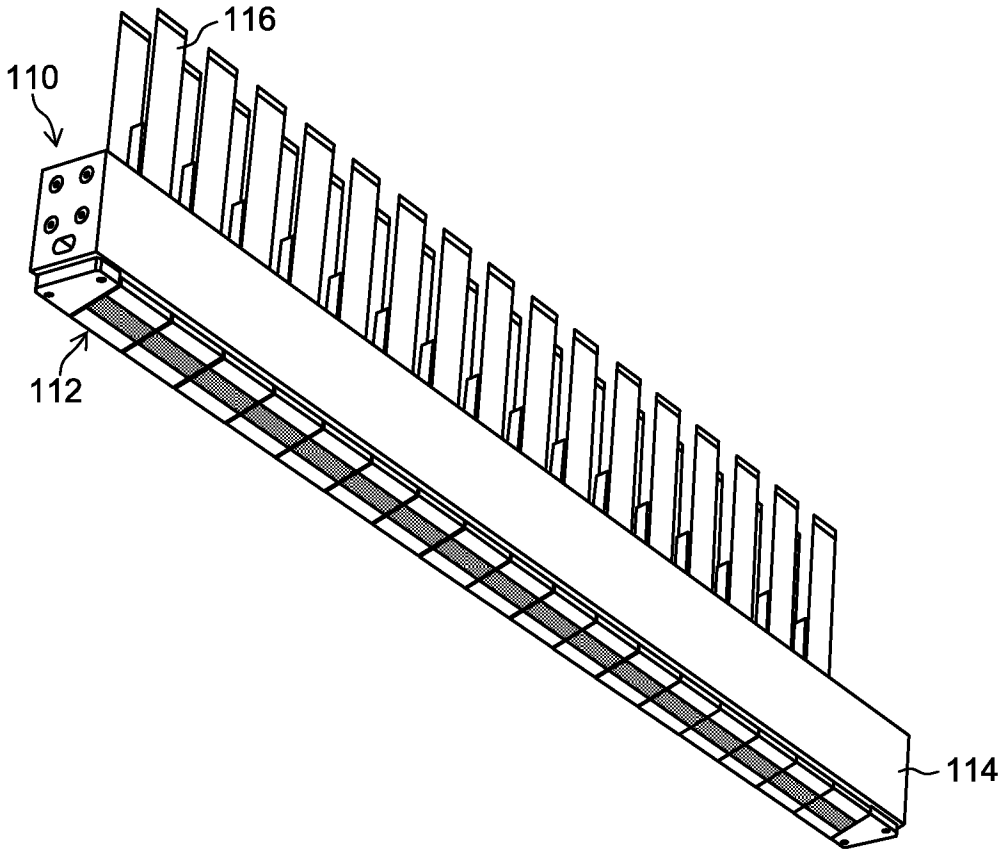
FIG. 13 is a perspective drawing of an inkjet head to which a sealing sheet according to an embodiment of the present invention is applied.

Next, the composition of an inkjet head in which a sealing sheet according to an embodiment of the present invention is applied is described. FIG. 13 is a perspective diagram of the inkjet head 110 to which the sealing sheet according to the embodiment of the present invention is applied. FIG. 13 shows a state looking up at the ejection surface of the inkjet head 110 from obliquely below the inkjet head 110. The inkjet head 110 is a print head configured to be arranged in an image formation unit of an inkjet printer, and is a full line-type bar head (a page-wide head for a single-pass printing method) formed to a long dimension by joining together a plurality of head modules 112 in the paper width direction. Here, an embodiment is shown in which seventeen head modules 112 are joined together, but the composition of the modules, the number of modules, and the arrangement thereof are not limited to the embodiment illustrated. The inkjet head 110 includes a housing 114, which is a frame for fixing the head modules 112 (a housing for composing the bar-shaped line head), and a flexible printed circuit board 116, which is connected to the head modules 112.

Figure 14:
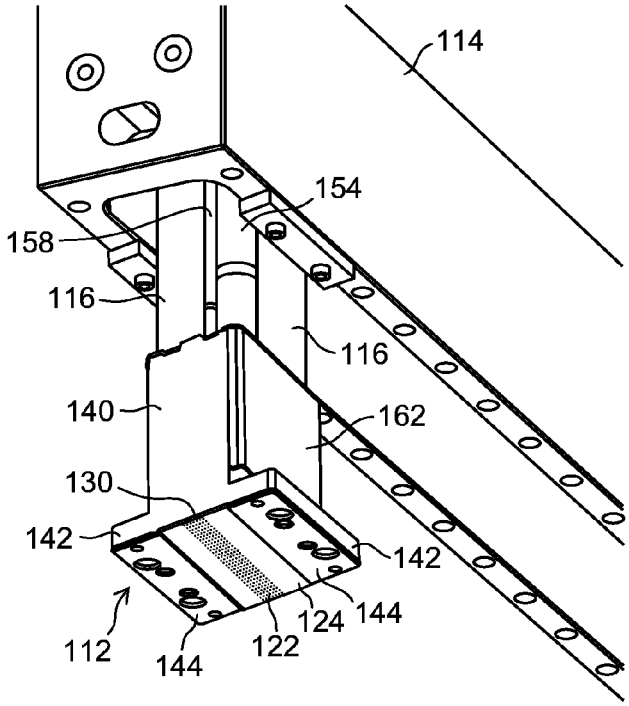
FIG. 14 is an enlarged diagram showing a state of installing a head module on a housing.

FIG. 14 is an enlarged view showing a state where one of the head modules 112 is installed onto the housing 114. Each of the head modules 112 includes an ejection device substrate 130 having an ejection surface (also referred to as the "nozzle surface") 124, in which a plurality of nozzle apertures 122 that are ink droplet ejection ports are formed, and a housing 140, which holds the ejection device substrate 130. The bottom portion of the housing 140 has wing sections 142, which extend to sides of the ejection device substrate 130, and the ejection device substrate 130 is arranged between the wing sections 142. The bottom surfaces of the wing sections 142 are covered with plate-shaped wing covers 144, and the head module 112 is coupled to the housing 114 of the bar head by fixing the wing sections 142 with the wing covers 144 to the housing 114.

The bottom surfaces of the wing sections 142 have steps receding from the ejection surface 124 of the ejection device substrate 130 by a distance of not smaller than the thickness of the wing covers 144, in such a manner that the bottom surfaces of the wing covers 144 are flush with or slightly recedes from the ejection surface 124.

Although not shown in FIG. 14, sealing sheets 410 (shown in FIG. 18) having the sensor functions of detecting the liquids leaking in and out are bonded to each head module 112 on lateral side faces thereof which are perpendicular to the lengthwise direction of the bar head (the direction in which the head modules 112 are arranged).

Figure 15:
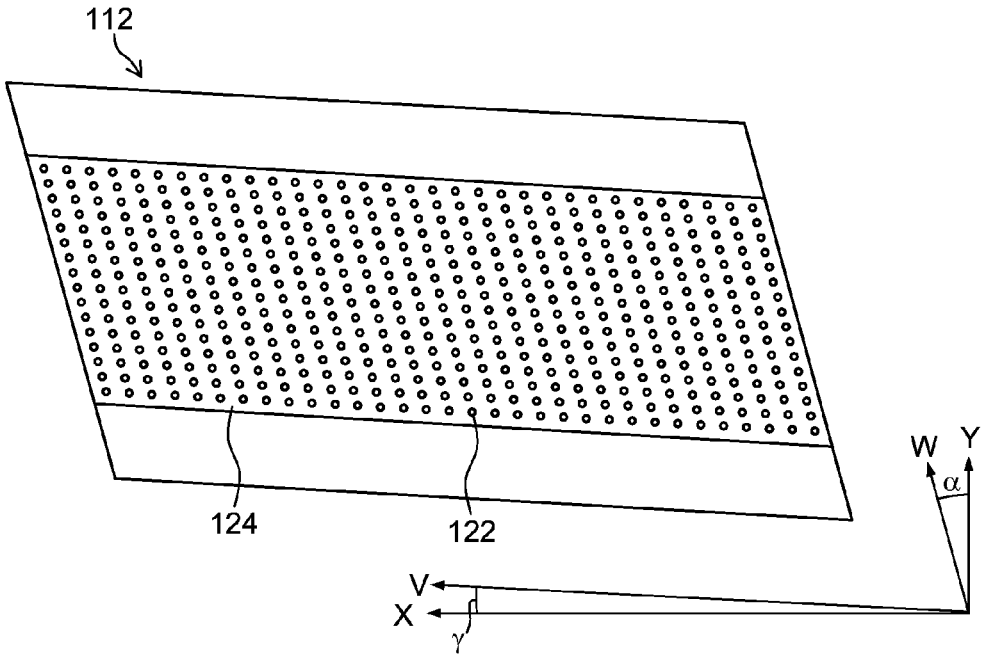
FIG. 15 is a plan diagram of a nozzle surface of the head module.

There are no particular restrictions on the number and arrangement of the nozzle apertures 122 formed in the ejection surface 124 of each head module 112, and one example is shown in FIG. 15.

FIG. 15 is a plan diagram of the nozzle surface 124 of the head module 112, as viewed from the ejection side. FIG. 15 shows a reduced number of nozzle apertures 122, and for example, 32×64 nozzle apertures are two-dimensionally arranged in the ink ejection surface 124 of one head module 112. In FIG. 15, the Y direction is the direction of conveyance of the recording medium (e.g., paper) (also referred to as the "sub-scanning direction"), and the X direction is the widthwise direction of the recording medium (also referred to as the "main scanning direction"). The head module 112 has a planar parallelogram shape having end faces on the long edge sides following the V direction inclined to the X direction by an angle $\gamma$, and end faces on the short edge sides following the W direction inclined to the Y direction by an angle $\alpha$. By combining the plurality of head modules 112 in the X direction (the paper width direction), as shown in FIG. 13, the nozzle rows covering the whole image formation range are formed in the paper width direction, and hence a full line-type of head capable of performing image recording at a prescribed recording resolution (for example, 1200 dpi) in one image formation scanning action is composed.

Figure 16:
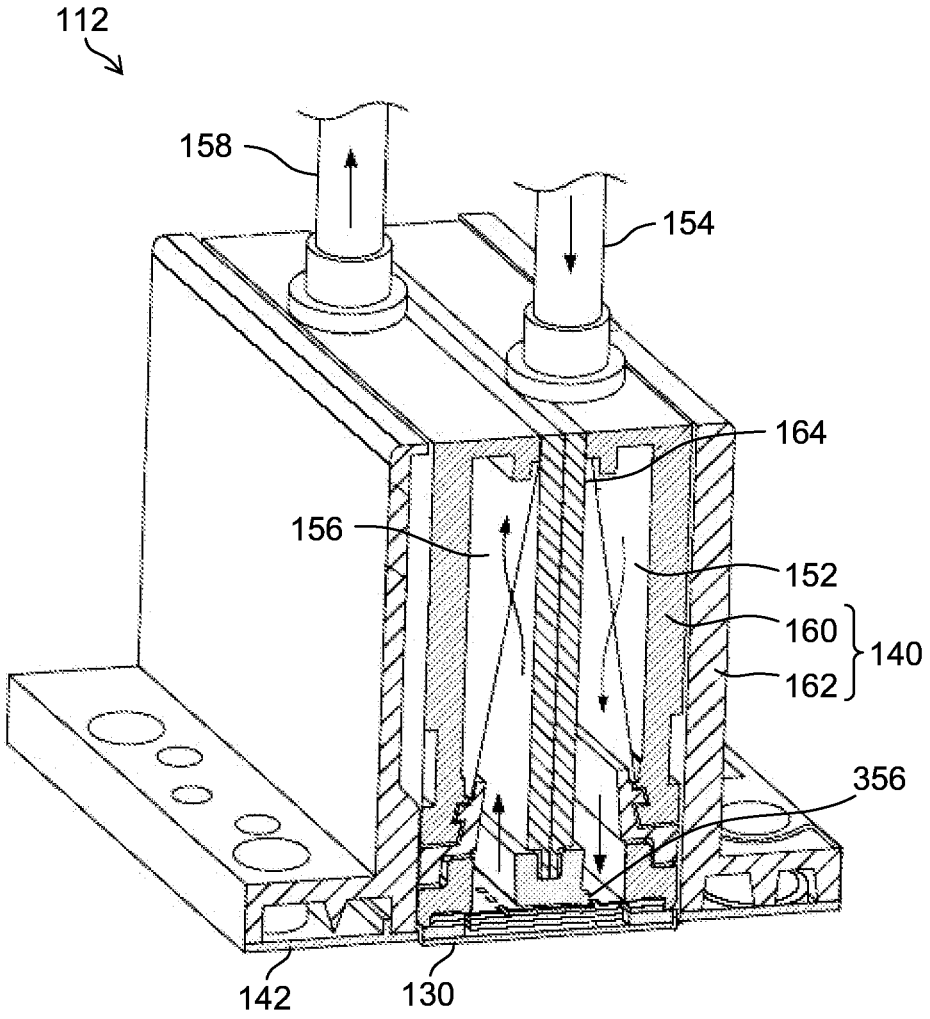
FIG. 16 is a perspective diagram of the head module.

FIG. 16 is a perspective diagram of the head module 112 (including a partial cross-sectional diagram). The head module 112 has an ink supply and recovery unit constituted of an ink supply chamber 152 and an ink recovery chamber 156, and the like, on the upper side in FIG. 16 or the opposite side of the ejection device substrate 130 to the ejection surface 124. The ink supply chamber 152 is connected to an ink supply tank (not shown) through an ink supply pipe 154, and the ink recovery chamber 156 is connected to an ink recovery tank (not shown) through an ink recovery pipe 158.

The housing 140 of the head module 112 has a dual structure including an internal housing 160 and an external housing 162 covering the internal housing 160. A partition member 164 dividing the ink supply chamber 152 and the ink recovery chamber 156 is arranged at substantially the center of the internal housing 160, and the spaces of the two chambers 152 and 156 are separated on either side of the partition member 164. Although not depicted in FIG. 16, the flexible printed circuit board 116 is arranged between the internal housing 160 and the external housing 162, and is extracted upward in FIG. 16 (see FIG. 13).

Figure 17:
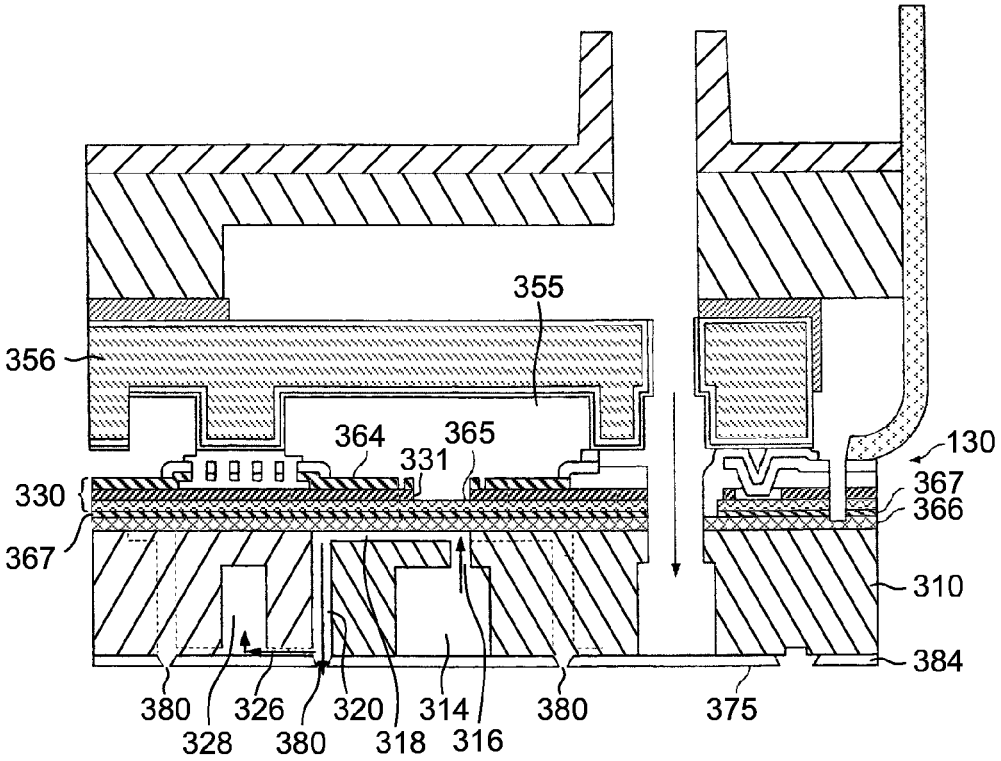
FIG. 17 is a cross-sectional diagram showing an internal structure of an ejection device substrate in the head module.

FIG. 17 is a cross-sectional diagram showing the internal structure of the ejection device substrate 130 in the head module 112. The ejection device substrate 130 includes: an ink supply channel (supply side common flow channel) 314; an individual ink supply channel (supply restricting flow channel) 316, which connects the ink supply channel 314 to a pressure chamber 318; a nozzle connection channel 320, which connects the pressure chamber 318 to a nozzle 380 (of which the aperture 122 is shown in FIGS. 14 and 15); and an individual ink recovery channel (recovery restricting flow channel) 326, which connects the nozzle connection channel 320 to an ink recovery channel (recovery side common flow channel) 328. A nozzle plate 384 formed with the nozzles 380 is arranged on the lower side of a flow channel structure body 310 formed with the ink flow channels 314, 316, 318, 320, 326 and 328. A diaphragm 366 is arranged on the upper side of the flow channel structure body 310. A piezoelectric element 330 constituted of a layered structure including a lower electrode (common electrode) 365, a piezoelectric layer 331 and an upper electrode (individual electrode) 364 is arranged on the diaphragm 366 through a bonding layer 367. The upper electrodes 364 are the individual electrodes, which are patterned so as to correspond respectively to the shapes of the pressure chambers 318, and the piezoelectric elements 330

(functioning as "ejection energy generating elements") are arranged respectively on the pressure chambers 318.

The ink supply channel 314 is connected to the ink supply chamber 152 shown in FIG. 16, and the ink is supplied to the pressure chambers 318 from the ink supply channel 314 through the supply restricting flow channels 316. According to an image signal of the image that is to be formed, a drive voltage is applied to the upper electrode 364 of the piezoelectric element 330 correspondingly arranged on the pressure chamber 318 connecting to the nozzle 380 designated to perform ink ejection, the piezoelectric element 330 and the diaphragm 366 change in shape, causing the volume of the pressure chamber 318 to change, and the resulting pressure change causes the ink in the pressure chamber 318 to be ejected from the nozzle 380 through the nozzle connection channel 320.

The recovery restricting flow channel 326 is arranged in the vicinity of the nozzle 380, and the ink that is not used for ejection is recovered to the ink recovery flow channel 328 through the recovery restricting flow channel 326. The ink recovery flow channel 328 is connected to the ink recovery chamber 156 shown in FIG. 16. By constantly recovering the ink into the ink recovery flow channel 328 through the recovery restricting flow channel 326, increase in the viscosity of the ink in the vicinity of the nozzles 380 when not performing ejection is prevented.

The laminated structure constituted of the nozzle plate 384, the flow channel structure body 310, the diaphragm 366 and the piezoelectric elements 330 forms an ejection device structure or the ejection device substrate 130. An intermediate plate 356 (also referred to as a "piezoelectric element cover plate"), which covers the piezoelectric elements 330 while ensuring spaces 355 that permit displacement of the piezoelectric elements 330, is arranged over the piezoelectric elements 330.

Figure 18:
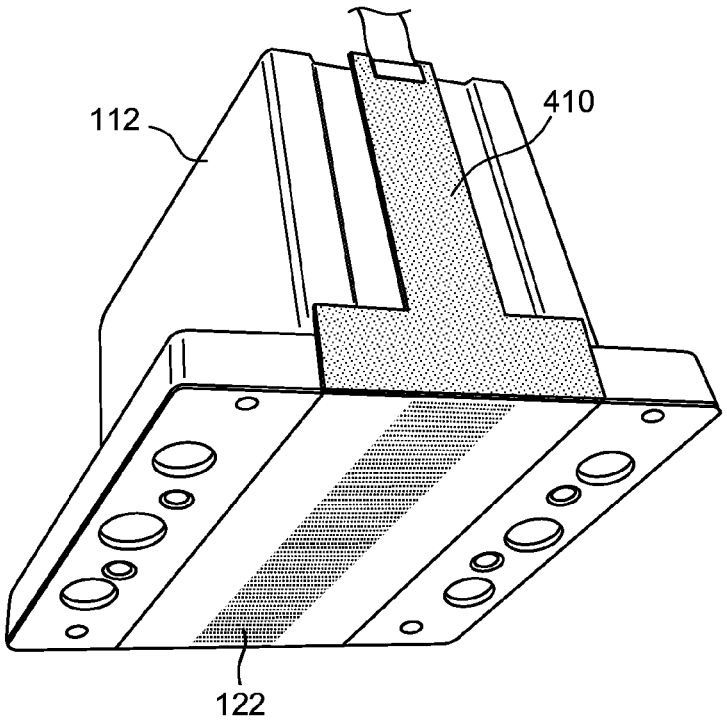
FIG. 18 is an external view of the head module to which the sealing sheet has been bonded.

FIG. 18 is a diagram showing a state where the sealing sheet 410 has been bonded to the lateral side face of the head module 112. The sealing sheet 410 is bonded to a portion of the lateral side face of the head module 112, as shown in FIG. 18. For the sealing sheet 410, it is possible to employ any of the compositions of the sealing sheets 10, 70 and 80 described above with reference to FIGS. 1 to 12C.

FIG. 18 shows one of the lateral side faces of the head module 112, and another sealing sheet 410 is similarly bonded to the head module 112 on the opposite lateral side face thereof, which is not shown in FIG. 18. As described with reference to FIGS. 16 and 17, the ejection device substrate 130 of the head module 112 has the laminated structure, which tends to allow the liquids readily leak into and out of the ejection device substrate 130 through the lateral side faces of the laminated structure. Therefore, it is desirable that the sealing sheets 410 are applied to cover and seal the lateral side faces of the laminated structure. In the present embodiment, the lateral side faces of the ejection device substrate 130 in the head module 112 are considered as the interface regions which need to be sealed (the sealed regions) and the sealing sheets 410 are bonded so as to cover and seal the sealed regions.

By adopting the above-described composition, it is possible to restrain the internal liquid from leaking out and the external liquid from leaking in, as well as being able to electrically detect the internal liquid leaking out and the external liquid leaking in, should it occur, and the detection signal can be used to implement suitable control, such as issuing a warning or halting the apparatus, or the like.

<Embodiment of Composition of Inkjet Recording Apparatus>

An inkjet recording apparatus which employs the inkjet heads 110 according to any of the above-described embodiments of the present invention is now explained.

Figure 19:
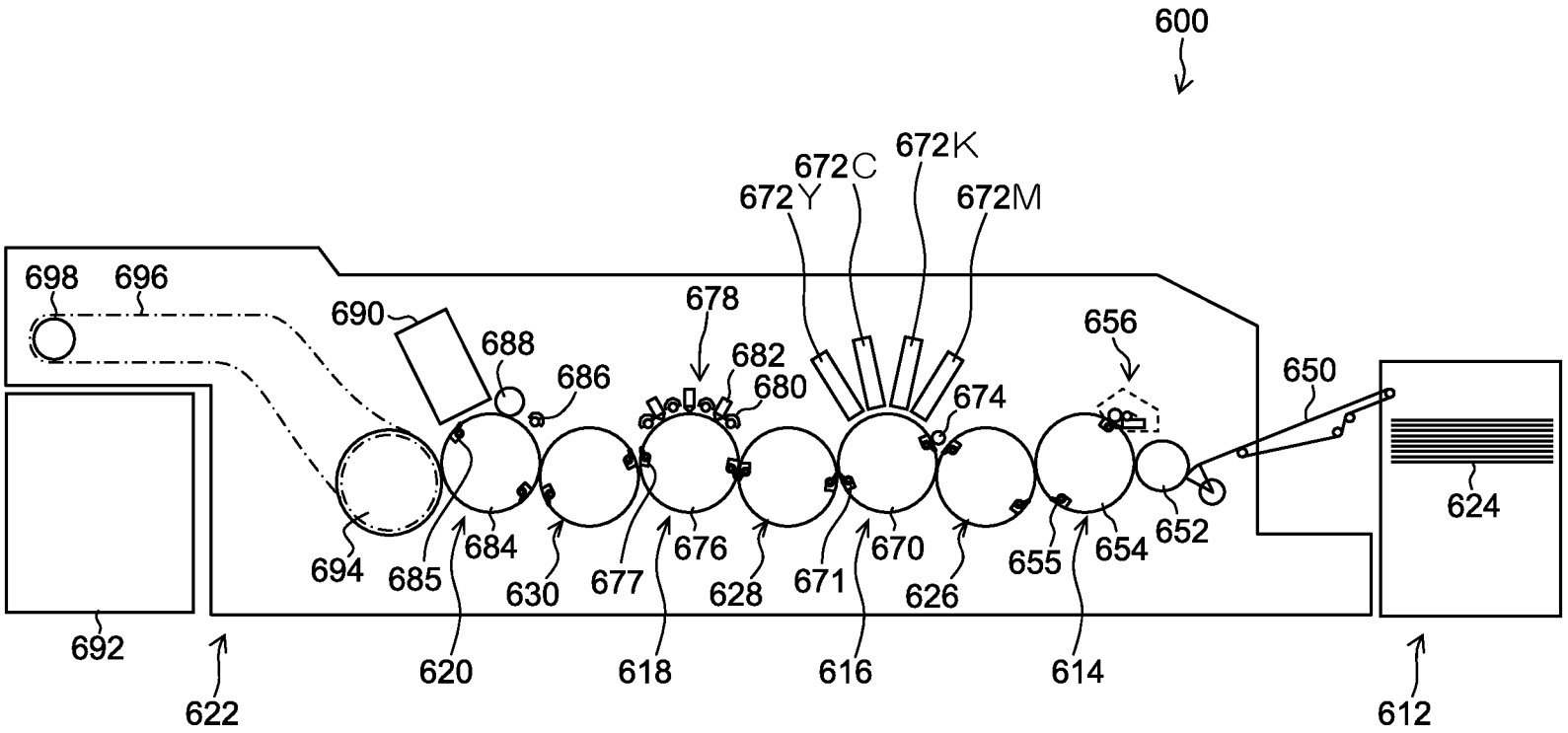
FIG. 19 is a schematic drawing of an inkjet recording apparatus according to an embodiment of the present invention.

FIG. 19 is a schematic drawing showing the composition of the inkjet recording apparatus 600 according to an embodiment of the present invention. The inkjet recording apparatus 600 is a single-pass inkjet recording apparatus, which forms a desired color image by ejecting and depositing droplets of inks of a plurality of colors (e.g., magenta (M), black (K), cyan (C) and yellow (Y)) from inkjet heads 672M, 672K, 672C and 672Y onto a recording medium 624 (hereinafter also referred to as "paper" for the sake of convenience) held on a pressure drum (image formation drum) 670 of an image formation unit 616. The inkjet recording apparatus 600 is an image forming apparatus of a drop on-demand type employing a two-liquid reaction (aggregation) method in which an image is formed on the recording medium 624 by depositing a treatment liquid (here, an aggregating treatment liquid) on the recording medium 624 before depositing droplets of the inks, and causing the treatment liquid and the ink liquid to react together.

As shown in FIG. 19, the inkjet recording apparatus 600 includes a paper feed unit 612, a treatment liquid deposition unit 614, the image formation unit 616, a drying unit 618, a fixing unit 620, and a paper output unit 622.

<<Paper Supply Unit>>

The paper supply unit 612 includes a paper supply tray 650, and the recording medium 624 is supplied one sheet at a time to the treatment liquid deposition unit 614 from the paper supply tray 650. In the present embodiment, cut sheets of paper (cut paper) are used as the recording media 624; however, it is also possible to adopt a composition in which paper is supplied from a continuous roll (rolled paper) and is cut to the required size.

<<Treatment Liquid Deposition Unit>>

The treatment liquid deposition unit 614 is a mechanism which deposits the treatment liquid onto a recording surface of the recording medium 624. The treatment liquid includes a coloring material aggregating agent, which aggregates the coloring material (in the present embodiment, the pigment) in the inks deposited by the image formation unit 616, and the separation of the ink into the coloring material and the solvent is promoted due to the treatment liquid and the inks making contact with each other.

The treatment liquid deposition unit 614 includes a paper supply drum 652, a treatment liquid drum 654, and a treatment liquid application device 656. The treatment liquid drum 654 has a hook-shaped holding device (gripper) 655 on an outer circumferential surface thereof, so as to be able to hold a leading end of the recording medium 624.

The treatment liquid application device 656 has a treatment liquid vessel, in which the treatment liquid is stored, an anilox roller, which is partially immersed in the treatment liquid in the treatment liquid vessel, and a rubber roller, which transfers the treatment liquid from the anilox roller to the recording medium 624 on the treatment liquid drum 654. In the treatment liquid application device 656, it is possible to apply the treatment liquid to the recording medium 624 while dosing the amount of the treatment liquid. Instead of the application method using the rollers, it is also possible to employ various other methods, such as a spraying method, an inkjet method, or the like, to deposit the treatment liquid to the recording medium 624.

The recording medium 624 onto which the treatment liquid has been deposited by the treatment liquid deposition unit 614 is transferred from the treatment liquid drum 654 to the image formation drum 670 of the image formation unit 616 through an intermediate conveyance unit 626.

<<Image Formation Unit>>

The image formation unit 616 includes the image formation drum 670, a paper pressing roller 674, and the inkjet heads 672M, 672K, 672C and 672Y. Similarly to the treatment liquid drum 654, the image formation drum 670 has a hook-shaped holding device (gripper) 671 on the outer circumferential surface of the drum. Droplets of the inks are deposited onto the recording medium 624 fixed on the image formation drum 670, from the inkjet heads 672M, 672K, 672C and 672Y.

Each of the inkjet heads 672M, 672K, 672C and 672Y is a full-line type inkjet recording head having a length corresponding to the maximum width of the image forming region on the recording medium 624, and a row of nozzles for ejecting the ink droplets arranged throughout the whole width of the image forming region is formed in the ink ejection surface of each head. The composition of each of the inkjet heads 672M, 672K, 672C and 672Y is similar to the composition of the inkjet head 110 described above with reference to FIGS. 13 to 18. Each of the inkjet heads 672M, 672K, 672C and 672Y is formed to a long dimension by joining together the head modules 112, and a sealing sheet 410 is bonded to each lateral end face of each of the head modules 112 (see FIG. 18).

The inkjet heads 672M, 672K, 672C and 672Y are disposed so as to extend in a direction perpendicular to the conveyance direction of the recording medium 624 (the direction of rotation of the image formation drum 670).

When the droplets of the corresponding colored inks are ejected and deposited from the inkjet heads 672M, 672K, 672C and 672Y to the recording surface of the recording medium 624 held tightly on the image formation drum 670, the inks make contact with the treatment liquid having previously been deposited on the recording surface, the coloring materials (pigments) dispersed in the inks are aggregated, and a coloring material aggregate is thereby formed. By this means, flowing of the coloring materials, and the like, on the recording medium 624 is prevented and an image is formed on the recording surface of the recording medium 624.

The recording medium 624 on which the image has been formed in the image formation unit 616 is transferred from the image formation drum 670 to a drying drum 676 of the drying unit 618 through an intermediate conveyance unit 628.

Although the configuration with the CMYK standard four colors is described in the present embodiment, combinations of the ink colors and the number of colors are not limited to those. As required, light inks, dark inks, and/or special color inks can be added. For example, a configuration in which inkjet heads for ejecting light-colored inks such as light cyan and light magenta are added is possible. Moreover, there are no particular restrictions of the sequence in which the heads of respective colors are arranged.

<<Drying Unit>>

The drying unit 618 includes a drying drum 676 and a solvent drying device 678, and is a mechanism which dries the water content contained in the solvent which has been separated by the action of aggregating the coloring material.

The drying drum 676 has a hook-shaped holding device (gripper) 677 arranged on the outer circumferential surface thereof, in such a manner that the leading end of the recording medium 624 can be held by the holding device 677.

The solvent drying device 678 includes a plurality of halogen heaters 680 and hot air spraying nozzles 682 disposed respectively between the halogen heaters 680. The recording medium 624 on which a drying process has been carried out in the drying unit 618 is transferred from the drying drum 676 to a fixing drum 684 of the fixing unit 620 through an intermediate conveyance unit 630.

<<Fixing Unit>>

The fixing unit 620 includes the fixing drum 684, a halogen heater 686, a fixing roller 688, and an in-line sensor 690. The fixing drum 684 has a hook-shaped holding device (gripper) 685 arranged on the outer circumferential surface thereof, in such a manner that the leading end of the recording medium 624 can be held by the holding device 685.

By means of the rotation of the fixing drum 684, the recording medium 624 is conveyed with the recording surface facing to the outer side, and preliminary heating by the halogen heater 686, a fixing process by the fixing roller 688 and inspection by the in-line sensor 690 are carried out in respect of the recording surface.

The fixing roller 688 is a roller member configured to apply heat and pressure to the recording medium 624, for melting self-dispersing polymer micro-particles contained in the inks and thereby causing the inks to form a film. More specifically, the fixing roller 688 is disposed so as to press the fixing drum 684, in such a manner that a nip roller is created between the fixing roller 688 and the fixing drum 684.

Instead of the ink containing a high-boiling-point solvent and polymer micro-particles (thermoplastic resin particles), it is also possible to use an ink containing a monomer that can be polymerized and cured by being irradiated with ultraviolet (UV) light. In this case, the inkjet recording apparatus 600 is provided with a UV irradiation unit configured to irradiate the inks on the recording medium 624 with UV light, instead of the heat and pressure fixing unit including the heat roller (fixing roller 688). In this way, if using the ink containing an active light-curable resin, such as a ultraviolet-curable resin, a device which irradiates the ink with the active light, such as a UV lamp or an ultraviolet LD (laser diode) array, is arranged instead of the fixing roller 688 for heat fixing.

The in-line sensor 690 is a reading device for measuring an ejection defect checking pattern, or the image density, image defects, or the like (including a test pattern, and the like) which has been recorded on the recording medium 624, and a CCD line sensor, or the like, is employed for the in-line sensor 690.

<<Paper Output Unit>>

The paper output unit 622 includes an output tray 692, and the paper output unit 622 further includes, between the output tray 692 and the fixing drum 684 of the fixing unit 620, a transfer drum 694, conveyance belts 696 and a tensioning roller 698, which are disposed to oppose the output tray 692 and the fixing drum 684. The recording medium 624 is sent to the conveyance belt 696 by the transfer drum 694 and output to the output tray 692. The details of the paper conveyance mechanism created by the conveyance belt 696 are not shown, and the leading end portion of the recording medium 624 after printing is held by a gripper on a bar (not shown) which spans between endless conveyance belts 696, and the recording medium 624 is conveyed about the output tray 692 due to the rotation of the conveyance belts 696.

Furthermore, although not shown in FIG. 17, the inkjet recording apparatus 600 according to the present embodiment further includes: an ink storing and loading unit, which supplies the inks to the inkjet heads 672M, 672K, 672C and 672Y; and a device which supplies the treatment liquid to the treatment liquid deposition unit 614; a head maintenance unit, which carries out cleaning (nozzle surface wiping, purging, nozzle sucking, and the like) of the inkjet heads 672M, 672K, 672C and 672Y; a position determination sensor, which determines the position of the recording medium 624 in the paper conveyance path; a temperature sensor, which determines the temperature of the respective units of the inkjet recording apparatus 600, and the like. The head maintenance unit is provided with a device which deposits the cleaning liquid onto the nozzle surface, and a web which acts as a wiping device that wipes the nozzle surface.

<<Description of Control System>>

Figure 20:
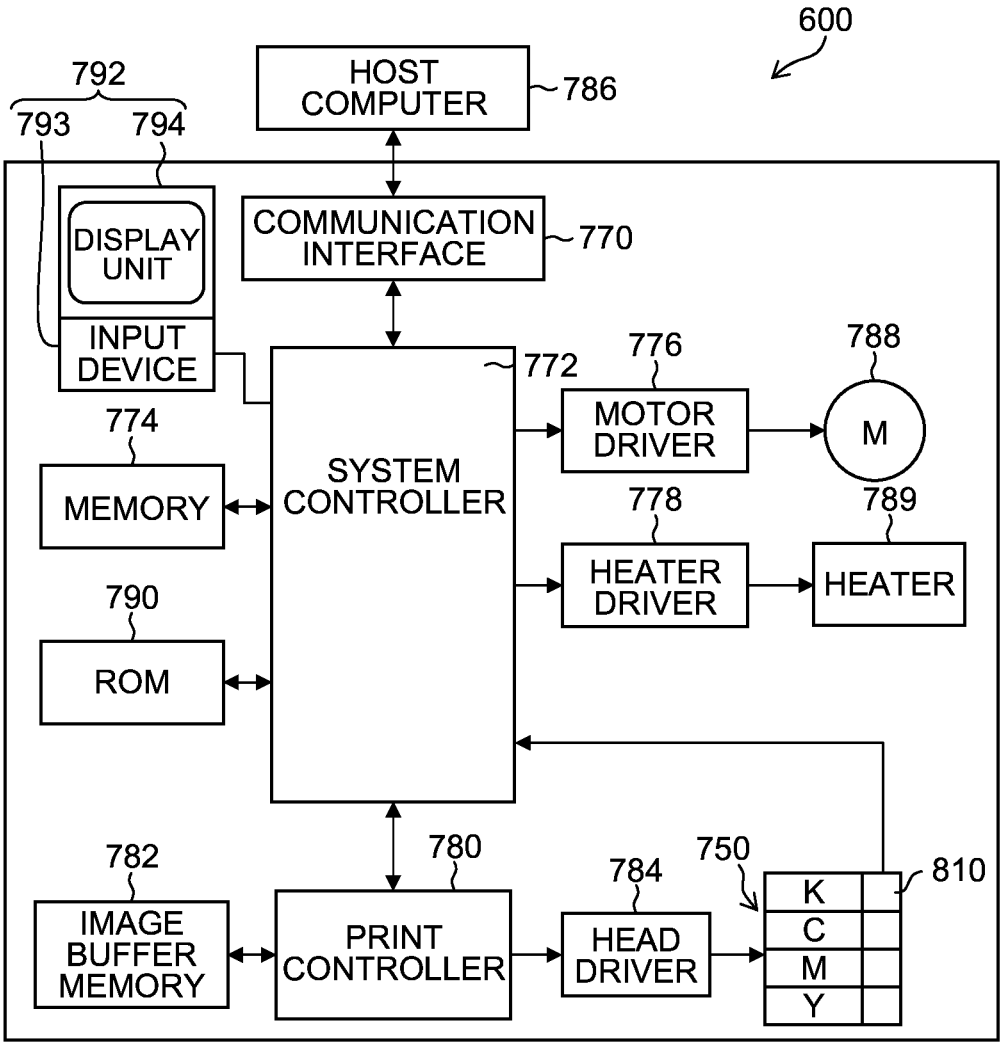
FIG. 20 is a block diagram showing main parts constituting the system of the inkjet recording apparatus.

FIG. 20 is a block diagram showing main parts constituting the system of the inkjet recording apparatus 600. The inkjet recording apparatus 600 includes a communication interface 770, a system controller 772, a memory 774, a motor driver 776, a heater driver 778, a print controller 780, an image buffer memory 782, a head driver 784, and the like.

The communication interface 770 is an interface unit for receiving image data sent from a host computer 786. A serial interface such as USB (Universal Serial Bus), IEEE1394, Ethernet, and wireless network, or a parallel interface such as a Centronics interface can be used as the communication interface 770. A buffer memory (not shown) can be mounted in the communication interface 770 in order to increase the communication speed. The image data sent from the host computer 786 is received by the inkjet recording apparatus 600 through the communication interface 770, and is temporarily stored in the memory 774.

The memory 774 is a storage device for temporarily storing images inputted through the communication interface 770, and data is written and read to and from the memory 774 through the system controller 772. The memory 774 is not limited to a memory composed of semiconductor elements, and a hard disk drive or another magnetic medium can be used.

The system controller 772 is constituted of a central processing unit (CPU) and peripheral circuits thereof, and the like, and functions as a control device for controlling the whole of the inkjet recording apparatus 600 in accordance with a prescribed program, as well as a calculation device for performing various calculations. Control programs of various types and parameters of various types, and the like, are stored in the ROM 790, and the control programs are read out and executed in accordance with instructions from the system controller 772.

The memory 774 is utilized as a temporary storage area of the image data, and also utilized as an expansion area of the program and a calculation operation area of the CPU.

The motor driver 776 is a driver which drives the motors 788 in accordance with instructions from the system controller 772. In FIG. 20, various motors arranged in the respective units of the inkjet recording apparatus 600 are denoted with the reference numeral 788.

The heater driver 778 is a driver which drives the heaters 789 in accordance with instructions from the system controller 772. In FIG. 20, various heaters arranged in the respective units of the inkjet recording apparatus 600 are denoted with the reference numeral 789.

The print controller 780 has a signal processing function for performing various tasks, compensations, and other types of processing for generating print control signals from the image data stored in the memory 774 in accordance with commands from the system controller 772 so as to supply the generated print data (dot image data) to the head driver 784.

The dot image data is generated by subjecting the input multiple-tone image data to color conversion processing and half-tone processing. The color conversion processing is processing for converting image data represented by an sRGB system, for instance (for example, 8-bit RGB color image data) into image data of the respective colors of inks used by the inkjet recording apparatus 600 (KCMY color data, in the present embodiment).

Half-tone processing is processing for converting the color data of the respective colors generated by the color conversion processing into dot data of respective colors (in the present embodiment, KCMY dot data) by error diffusion or the like.

Prescribed signal processing is carried out in the print controller 780, and the ejection amount and the ejection timing of the ink droplets from the respective inkjet heads 750 (here, the inkjet heads 672M, 672K, 672C and 672Y of the respective colors are denoted with the reference numeral 750) are controlled through the head driver 784, on the basis of the obtained dot data. By this means, prescribed dot size and dot positions can be achieved.

The image buffer memory 782 is arranged in the print controller 780, and image data, parameters, and other data are temporarily stored in the image buffer memory 782 when the image data is processed in the print controller 780. Also possible is a mode in which the print controller 780 and the system controller 772 are integrated to form a single processor.

The head driver 784 can incorporate a feedback control system for maintaining uniform drive conditions in the inkjet heads 750.

The inkjet image recording apparatus 600 in the present embodiment employs a drive method in which a common drive power waveform signal is applied to the piezoelectric actuators (piezoelectric elements 330) of the inkjet heads 750, and the ink droplets are ejected from the nozzles 380 corresponding to the respective piezoelectric actuators by turning switching elements (not shown) connected to the individual electrodes of the piezoelectric actuators on and off, in accordance with the ejection timing of the respective piezoelectric actuators.

The operating unit 792 forming a user interface is constituted of an input device 793 for the operator (user) to make various inputs and a display unit (display) 794. The input device 793 can employ various modes, such as a keyboard, mouse, touch panel, buttons, or the like. By operating the input device 793, the operator can perform actions such as entering print conditions, entering and editing additional information, searching for information, entering various commands, and the like, and can confirm various information such as input content, search results, and the like, through the display on the display unit 794.

The sealing sheets 410 are bonded respectively to the head modules 112, which constitute the heads 750 (see FIG. 18). In FIG. 20, the sensor sections which are constituted of the leakage detection electrodes 20 and 30 formed on the respective sealing sheets 410 are denoted with the reference numeral 810.

The sensor sections 810 are connected to the system controller 772, and the system controller 772 determines change in the electrical resistance value on the basis of the electrical signals obtained from the sensor sections 810, and judges either one of or both of the leakage of the internal liquids out of the head modules 112 (e.g., the leakage of the inks), the leakage of the external liquids toward the head modules 112 (e.g., the leakage of the cleaning liquid and the previously ejected inks). The system controller 772 is able to identify in which module, of the plurality of head modules 112, the liquid leakage out or in has occurred, on the basis of the information obtained from the sensor sections 810.

The system controller 772 carries out prescribed control, such as displaying a warning on the display unit 794, when an abnormality has been detected on the basis of the information obtained from the sensor sections 810. For example, information specifying the location of the head module 112 in which the liquid leakage out or in has been detected is displayed on the display unit 794, and a warning message prompting replacement of the leaking head module 112 is shown. Alternatively, when the liquid leakage out or in has been detected, instead of the warning display described above, or in conjunction with same, it is also possible to implement control to halt the printing operation and forcibly switch off the power supply, or the like.

The combination of the system controller 772 and the display unit 794 in the present embodiment corresponds to the "warning device". Each of the head modules 112 or the inkjet head 110 composed by joining the head modules 112 together of the present embodiment corresponds to the "liquid ejection head". The combination of the system controller 772 and the print controller 780 corresponds to an ejection control device which controls an ejection operation by the liquid ejection head.

<Recording Medium>

The "recording medium" is a general term for a medium on which dots are recorded by droplets ejected from an inkjet head, and this includes various terms, such as print medium, recording medium, image forming medium, image receiving medium, ejection receiving medium, and the like. In implementing the present invention, there are no particular restrictions on the material or shape, or other features, of the recording medium, and it is possible to employ various different media, irrespective of their material or shape, such as continuous paper, cut paper, seal paper, OHP sheets or other resin sheets, film, woven cloth, nonwoven cloth, a substrate for a printed circuit board on which a wiring pattern, or the like, is formed, or a rubber sheet.

<Device for Causing Relative Movement of Head and Paper>

In the embodiment described above, an example is given in which the recording medium is conveyed with respect to a stationary head, but in implementing the present invention, it is also possible to move a head with respect to a stationary recording medium (image formation receiving medium). A full line type recording head based on a single pass method is normally arranged in a direction perpendicular to the feed direction of the recording medium (conveyance direction), but a mode is also possible in which a head is arranged in an oblique direction forming a certain prescribed angle with respect to the direction perpendicular to the conveyance direction.

Furthermore, the range of application of the present invention is not limited to a single-pass printing method based on a line type of head, and it is also possible to apply a method which carries out printing by performing a scanning action, in the width direction of the recording medium, with a short head which does not cover the length of the recording medium in the width direction (main scanning direction).

<Ejection Method>

The device which generates pressure for ejection (ejection energy) in order to eject droplets from the nozzles of the inkjet head is not limited to the piezoelectric actuator (piezoelectric element). Apart from the piezoelectric element, it is also possible to employ pressure generating elements (ejection energy generating elements) of various kinds, such as a heater (heating element) in a thermal method (a method which ejects ink by using the pressure produced by film boiling caused by heat from the heater), or various actuators based on other methods. A corresponding energy generating element is arranged in the flow channel structure in accordance with the ejection method of the head.

<Examples of Application of Apparatus>

In the embodiment described above, the inkjet recording apparatus, which is categorized as the inkjet printer, has been described by way of an example; however, the scope of application of the present invention is not limited to this. The present invention is not limited to the inkjet system for graphic printing applications, and can also be applied widely to apparatuses (referred to generically as "inkjet apparatuses") which create various shapes or patterns using functional material in liquid form, such as a wire image formation apparatus which forms an image of a wire pattern for an electronic circuit, manufacturing apparatuses for various devices, a resist printing apparatus which uses resin liquid as a functional liquid for ejection, a color filter manufacturing apparatus, a fine structure forming apparatus for forming a fine structure using a material for material deposition, or the like.

Moreover, the sealing sheet according to the present invention is not limited to be applied to the liquid ejection head, and can also be applied to mobile phones, cameras, audio equipment, portable game devices, personal computers, and various other electronic equipment, apparatuses, and devices.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A sealing sheet configured to restrain leakage of liquid in and out, the sealing sheet comprising:

a film member which is impermeable to the liquid and configured to cover a region that needs to be sealed; and electrical wires which are arranged on the film member, wherein an electrical signal corresponding to change in electrical resistance due to contact with the liquid is obtainable from the electrical wires, wherein the electrical wires include:

an internal leakage detection electrode configured to detect an internal liquid leaking out of the region that needs to be sealed; and an external leakage detection electrode configured to detect an external liquid going to leak into the region that needs to be sealed, wherein the sealing sheet is configured to cover a lateral side face of a laminated structure including a nozzle plate formed with a nozzle which has a liquid ejection port configured to eject liquid, a flow channel structure body formed with a flow channel which is configured to guide the liquid to the nozzle, and an ejection energy generating element which is configured to generate ejection energy to eject the liquid from the nozzle.

2. The sealing sheet as defined in claim 1, wherein the film member is made of one of resin, metal, and a combination of the resin and the metal.

3. The sealing sheet as defined in claim 1, wherein the electrical wires include a pair of a positive electrical wire and a negative electrical wire, the pair constituting a detection circuit.

4. The sealing sheet as defined in claim 1, wherein the film member is configured to be bonded with adhesive to a covered object having the region that needs to be sealed.

5. The sealing sheet as defined in claim 4, wherein the film member has a bonding layer containing the adhesive configured to bond the sealing sheet to the covered object.

6. The sealing sheet as defined in claim 4, wherein the electrical wires are arranged on a side to be bonded to the covered object, of the film member.

7. The sealing sheet as defined in claim 6, wherein a space where there is no adhesive is formed around the electrical wires.

8. The sealing sheet as defined in claim 1, wherein the electrical wires include a plurality of pairs of positive electrical wires and negative electrical wires, the pairs constituting a plurality of detection circuit systems.

9. The sealing sheet as defined in claim 1, wherein:

the electrical wires include a pair of a positive electrical wire and a negative electrical wire each of which has comb-shaped electrodes; and the electrodes of the positive electrical wire and the electrodes of the negative electrical wire are alternately arranged on an uppermost surface of the film member.

10. The sealing sheet as defined in claim 1, wherein the film member has a multi-terminal connector connected to ends of the electrical wires.

11. A liquid ejection head, comprising:

the sealing sheet as defined in claim 1 which is bonded to the liquid ejection head;

the nozzle which has the liquid ejection port configured to eject liquid;

the flow channel which is configured to guide the liquid to the nozzle; and the ejection energy generating element which is configured to generate ejection energy to eject the liquid from the nozzle.

12. The liquid ejection head as defined in claim 11, wherein the liquid ejection head is constituted of a plurality of head modules joined together, and the sealing sheet is bonded to a side face of each of the head modules.

13. An inkjet apparatus, comprising:

the liquid ejection head as defined in claim 11; and a warning device which is configured to report an abnormality in accordance with the electrical signal obtained from the electrical wires.

14. The sealing sheet as defined in claim 1, wherein the electrical wires are arranged in wiring patterns surrounding the region that needs to be sealed.

15. The sealing sheet as defined in claim 14, wherein the external leakage detection electrode is arranged in a wiring pattern surrounding the internal leakage detection electrode.

* * * * *